US007318724B2

(12) United States Patent
Kubicek et al.

(10) Patent No.: US 7,318,724 B2
(45) Date of Patent: Jan. 15, 2008

(54) WICK HOLDER AND WICK ASSEMBLY FOR CANDLE ASSEMBLY

(75) Inventors: Chris A. Kubicek, East Troy, WI (US); Cory J. Nelson, Racine, WI (US); Thomas J. Szymczak, Franksville, WI (US); Paul E. Furner, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 161 days.

(21) Appl. No.: 11/124,313

(22) Filed: May 6, 2005

(65) Prior Publication Data

US 2006/0057529 A1 Mar. 16, 2006

Related U.S. Application Data

(63) Continuation-in-part of application No. 10/978,744, filed on Nov. 1, 2004, now Pat. No. 7,229,280, which is a continuation-in-part of application No. 10/938,434, filed on Sep. 10, 2004.

(51) Int. Cl.
*F23D 3/16* (2006.01)

(52) U.S. Cl. ..... 431/289; 431/294; 431/325

(58) Field of Classification Search ..... 431/289, 431/295, 253, 322, 325, 294
See application file for complete search history.

(56) References Cited

U.S. PATENT DOCUMENTS

| | | | |
|---|---|---|---|
| 213,184 | A | 3/1879 | Frick |
| 405,786 | A | 6/1889 | Ludde |
| 407,051 | A | 7/1889 | Baumer |

(Continued)

FOREIGN PATENT DOCUMENTS

| | | |
|---|---|---|
| CA | 2208145 | 12/1998 |

(Continued)

OTHER PUBLICATIONS

Intl. Search Report dated Oct. 13, 2006, Appl. No. PCT/US 2006/020218 (4315PCT).

(Continued)

*Primary Examiner*—Steve McAllister
*Assistant Examiner*—Chuka C Ndubizu
(74) *Attorney, Agent, or Firm*—McCracken & Frank LLP

(57) ABSTRACT

A candle assembly includes a support base, a melting plate having a capillary pedestal, a wick holder that fits onto the capillary pedestal, and a fuel element that fits over the wick holder. The wick holder includes a sleeve having first and second open ends. A wick fits into the sleeve and extends between the open ends. The sleeve has a constricted portion, which is disposed between the open ends and has a cross-sectional area less than any other cross-sectional area between the open ends. The constricted portion reduces an effective capillary fluid flow capacity of the wick between the open ends, which may thereby regulate how quickly fuel is consumed when the candle assembly is burning. A capillary well disposed between the wick holder and the capillary pedestal may be adapted to promote a successful relight after an initial burn of the candle assembly. A candle holder, such as including the melting plate supported by a base, may be adapted to promote laminar air flow thereacross during a burn in a substantially calm atmospheric environment.

17 Claims, 13 Drawing Sheets

U.S. PATENT DOCUMENTS

| | | | | |
|---|---|---|---|---|
| 408,973 | A | | 8/1889 | Heller |
| 484,210 | A | | 10/1892 | Ludde |
| 779,644 | A | | 1/1905 | Ferrier |
| 837,240 | A | | 11/1906 | Mulkerins |
| 1,044,256 | A | | 11/1912 | Satter |
| D43,845 | S | | 4/1913 | Hirschfeld |
| 1,195,657 | A | | 8/1916 | Chersky |
| D49,902 | S | | 11/1916 | Labaree et al. |
| 1,229,140 | A | | 6/1917 | Ritter |
| 1,267,968 | A | * | 5/1918 | Bulle ..... 431/291 |
| 1,316,624 | A | | 9/1919 | Lucas |
| 1,320,109 | A | | 10/1919 | Wooster |
| 1,336,635 | A | | 4/1920 | Knapp |
| 1,390,389 | A | * | 9/1921 | Rosenfeld ..... 248/231.81 |
| 1,484,964 | A | | 2/1924 | Benneville |
| D67,108 | S | | 4/1925 | Steeple |
| 1,640,734 | A | | 8/1927 | Smith |
| D75,463 | S | | 6/1928 | Bach |
| D80,971 | S | | 4/1930 | Sakier |
| D83,100 | S | | 1/1931 | Gisolfi |
| D110,902 | S | | 8/1938 | Loesch |
| D119,587 | S | | 3/1940 | Fuerst |
| 2,234,903 | A | | 3/1941 | Muench |
| 2,237,523 | A | | 4/1941 | Damon |
| 2,246,346 | A | | 6/1941 | Wells |
| 2,254,906 | A | | 9/1941 | Petrulis |
| 2,324,753 | A | | 7/1943 | Alexiade |
| 2,354,343 | A | | 7/1944 | Webber et al. |
| 2,393,767 | A | | 1/1946 | Gould |
| 2,462,440 | A | | 2/1949 | Tierney |
| 2,494,995 | A | | 1/1950 | Gardner |
| 2,713,256 | A | | 7/1955 | Oesterle |
| 2,758,460 | A | | 8/1956 | Ciano |
| 2,775,006 | A | | 12/1956 | Kranc |
| 2,809,512 | A | | 10/1957 | Hartnett |
| RE24,423 | E | | 2/1958 | Oesterle et al. |
| 3,121,316 | A | | 2/1964 | Wilson |
| D206,946 | S | | 2/1967 | Knodt |
| D208,064 | S | | 7/1967 | Quistgaard et al. |
| D208,097 | S | | 7/1967 | Henn |
| 3,565,281 | A | | 2/1971 | Collie |
| D226,240 | S | | 1/1973 | Twedt |
| 3,730,674 | A | | 5/1973 | Gross |
| 3,741,711 | A | | 6/1973 | Bryant |
| 3,749,904 | A | | 7/1973 | Graff |
| 3,762,857 | A | | 10/1973 | Andeweg |
| D229,852 | S | | 1/1974 | Lindblad |
| D236,064 | S | | 7/1975 | Balbo |
| 3,898,039 | A | | 8/1975 | Lin |
| 3,910,753 | A | | 10/1975 | Lee |
| 3,932,113 | A | | 1/1976 | Thrush |
| 3,994,502 | A | | 11/1976 | Lombardi |
| 4,013,397 | A | | 3/1977 | Neugart |
| 4,019,856 | A | | 4/1977 | Lacroix |
| D247,635 | S | | 3/1978 | Maxwell |
| D248,499 | S | | 7/1978 | Ulrich et al. |
| D248,500 | S | | 7/1978 | Ulrich et al. |
| 4,102,634 | A | | 7/1978 | Crisp |
| D248,787 | S | | 8/1978 | Ulrich et al. |
| D248,788 | S | | 8/1978 | Ulrich et al. |
| D248,789 | S | | 8/1978 | Ulrich et al. |
| D253,432 | S | | 11/1979 | Van Koert |
| D253,732 | S | | 12/1979 | Van Koert |
| 4,185,953 | A | | 1/1980 | Schirneker |
| 4,206,500 | A | | 6/1980 | Neil |
| 4,206,560 | A | | 6/1980 | Sefried, II |
| 4,224,017 | A | | 9/1980 | Kayne |
| D264,385 | S | | 5/1982 | Meyer |
| 4,332,548 | A | | 6/1982 | Linton et al. |
| 4,381,914 | A | | 5/1983 | Ferguson |
| 4,427,366 | A | | 1/1984 | Moore |
| 4,477,249 | A | | 10/1984 | Ruzek et al. |
| 4,524,408 | A | | 6/1985 | Minera |
| 4,551,794 | A | | 11/1985 | Sandell |
| 4,557,687 | A | | 12/1985 | Schirneker |
| 4,568,269 | A | | 2/1986 | Lin |
| 4,568,270 | A | | 2/1986 | Marcus et al. |
| 4,588,618 | A | | 5/1986 | Wolfe |
| D292,525 | S | | 10/1987 | Van Deelen |
| 4,755,135 | A | | 7/1988 | Kwok |
| 4,781,895 | A | | 11/1988 | Spector |
| 4,804,323 | A | | 2/1989 | Kim |
| D312,507 | S | | 11/1990 | Thoreson |
| 4,983,119 | A | | 1/1991 | Lin |
| 5,015,175 | A | | 5/1991 | Lee |
| D320,266 | S | | 9/1991 | Kunze |
| 5,069,617 | A | | 12/1991 | Lin |
| 5,078,591 | A | | 1/1992 | Depres |
| 5,078,945 | A | | 1/1992 | Byron |
| 5,086,380 | A | | 2/1992 | Hedner, Jr. |
| D325,077 | S | | 3/1992 | Kearnes |
| 5,101,328 | A | | 3/1992 | Hai |
| 5,174,645 | A | | 12/1992 | Chung |
| 5,193,995 | A | | 3/1993 | Keller et al. |
| 5,338,187 | A | | 8/1994 | Elharar |
| 5,363,590 | A | | 11/1994 | Lee |
| D355,266 | S | | 2/1995 | Caplette et al. |
| D356,472 | S | | 3/1995 | Jaworski |
| 5,425,633 | A | | 6/1995 | Cole |
| D360,461 | S | | 7/1995 | Gillespie |
| D369,871 | S | | 5/1996 | Lui |
| D371,212 | S | | 6/1996 | Hardy et al. |
| D376,002 | S | | 11/1996 | Upson |
| D377,402 | S | | 1/1997 | Perkins |
| D383,944 | S | | 9/1997 | Lillelund et al. |
| 5,690,484 | A | | 11/1997 | Leonard et al. |
| D390,676 | S | | 2/1998 | Hollington |
| D391,119 | S | | 2/1998 | Rapaz |
| D393,910 | S | | 4/1998 | Chambers et al. |
| D394,513 | S | | 5/1998 | Davis |
| 5,807,096 | A | | 9/1998 | Shin et al. |
| D399,298 | S | | 10/1998 | Whitehead |
| 5,840,246 | A | | 11/1998 | Hammons et al. |
| 5,842,850 | A | | 12/1998 | Pappas |
| 5,843,194 | A | | 12/1998 | Spaulding |
| 5,871,553 | A | | 2/1999 | Spaulding |
| D410,756 | S | | 6/1999 | Kleinberg |
| 5,921,767 | A | | 7/1999 | Song |
| 5,927,959 | A | | 7/1999 | Johnson |
| 5,939,005 | A | | 8/1999 | Materna |
| 5,951,278 | A | | 9/1999 | Young et al. |
| 5,955,034 | A | | 9/1999 | Zaunbrecher et al. |
| 5,955,958 | A | | 9/1999 | Lu |
| 5,961,318 | A | * | 10/1999 | Chambers et al. ..... 431/320 |
| 5,961,967 | A | | 10/1999 | Powell et al. |
| D416,099 | S | | 11/1999 | Hardy |
| D416,341 | S | | 11/1999 | Allen |
| 5,980,241 | A | | 11/1999 | Schirneker |
| 6,019,804 | A | | 2/2000 | Requejo et al. |
| 6,033,209 | A | | 3/2000 | Shin et al. |
| D422,180 | S | | 4/2000 | Sundberg |
| 6,050,812 | A | | 4/2000 | Chuang |
| D425,220 | S | | 5/2000 | Klett et al. |
| D425,636 | S | | 5/2000 | Freeman |
| 6,059,564 | A | | 5/2000 | Morris |
| 6,062,847 | A | | 5/2000 | Pappas |
| 6,068,472 | A | | 5/2000 | Freeman et al. |
| D426,902 | S | | 6/2000 | Hardy et al. |
| 6,074,199 | A | | 6/2000 | Song |
| 6,079,975 | A | | 6/2000 | Conover |
| 6,099,877 | A | | 8/2000 | Schuppan |
| D430,943 | S | | 9/2000 | Zutler |
| D433,168 | S | | 10/2000 | Cousins |
| 6,129,771 | A | | 10/2000 | Ficke et al. |

| | | | |
|---|---|---|---|
| 6,152,728 | A | 11/2000 | Griffel |
| D435,100 | S | 12/2000 | Pesu et al. |
| D436,415 | S | 1/2001 | Hardy |
| 6,214,063 | B1 | 4/2001 | DeStefano et al. |
| D443,080 | S | 5/2001 | Klett et al. |
| D443,081 | S | 5/2001 | Klett et al. |
| D443,082 | S | 5/2001 | Klett et al. |
| D443,101 | S | 5/2001 | Williamson |
| 6,231,336 | B1 | 5/2001 | Chen |
| 6,241,362 | B1 | 6/2001 | Morrison |
| 6,241,513 | B1 | 6/2001 | Jeneral |
| D445,030 | S | 7/2001 | Croft et al. |
| D445,337 | S | 7/2001 | Croft et al. |
| 6,267,584 | B1 | 7/2001 | Zou |
| 6,270,339 | B1 | 8/2001 | Zou |
| 6,273,710 | B1 | 8/2001 | Zou |
| 6,276,925 | B1 | 8/2001 | Varga |
| D447,418 | S | 9/2001 | Bezek et al. |
| 6,290,489 | B1 | 9/2001 | Seidler |
| D448,867 | S | 10/2001 | Manocheo et al. |
| 6,296,477 | B1 | 10/2001 | Lin |
| 6,299,435 | B1 | 10/2001 | Freeman et al. |
| D450,395 | S | 11/2001 | Bellenger |
| D450,865 | S | 11/2001 | Bellenger et al. |
| 6,328,935 | B1 | 12/2001 | Buccellato |
| 6,361,013 | B1 | 3/2002 | Smith |
| 6,361,311 | B1 | 3/2002 | Smith |
| D455,486 | S | 4/2002 | Makino |
| D455,846 | S | 4/2002 | Araujo |
| D456,539 | S | 4/2002 | Leeds |
| 6,371,756 | B1 | 4/2002 | Toohey |
| D459,498 | S | 6/2002 | Araujo |
| 6,398,544 | B2 | 6/2002 | Wright et al. |
| D461,916 | S | 8/2002 | Araujo |
| D462,132 | S | 8/2002 | Papai |
| 6,428,311 | B1 | 8/2002 | Bernardo |
| 6,439,471 | B2 | 8/2002 | Ehrlich et al. |
| D462,793 | S | 9/2002 | Freeman et al. |
| 6,450,802 | B1 | 9/2002 | Steck |
| 6,454,561 | B1 * | 9/2002 | Colthar et al. ..... 431/289 |
| D464,745 | S | 10/2002 | Mangini et al. |
| 6,468,071 | B2 | 10/2002 | Zoy |
| D465,587 | S | 11/2002 | Papai |
| D466,236 | S | 11/2002 | Papai |
| 6,488,494 | B2 | 12/2002 | Lee |
| 6,491,516 | B1 | 12/2002 | Tal et al. |
| D469,550 | S | 1/2003 | Moeller |
| D469,893 | S | 2/2003 | Shen |
| 6,520,770 | B2 | 2/2003 | Zou |
| D471,299 | S | 3/2003 | Papai |
| 6,531,063 | B1 | 3/2003 | Rose |
| 6,537,063 | B1 | 3/2003 | Pecoskie |
| 6,543,268 | B2 | 4/2003 | Wright et al. |
| 6,544,302 | B2 | 4/2003 | Berger et al. |
| 6,551,365 | B2 | 4/2003 | Berger et al. |
| 6,554,448 | B2 | 4/2003 | Carpenter et al. |
| D474,854 | S | 5/2003 | Lam |
| 6,568,934 | B1 | 5/2003 | Butler |
| 6,575,613 | B2 | 6/2003 | Brown et al. |
| 6,579,089 | B1 | 6/2003 | Iu |
| 6,592,637 | B2 | 7/2003 | McGee et al. |
| 6,595,771 | B2 | 7/2003 | Chu |
| 6,616,308 | B2 | 9/2003 | Jensen et al. |
| D481,143 | S | 10/2003 | McMinn |
| D481,473 | S | 10/2003 | Walsh |
| 6,630,110 | B2 | 10/2003 | Urfig |
| 6,648,631 | B2 | 11/2003 | Wright et al. |
| D485,624 | S | 1/2004 | Kitamura |
| 6,688,880 | B1 | 2/2004 | Pangle |
| 6,695,611 | B2 | 2/2004 | Lee |
| D487,687 | S | 3/2004 | Shields, Jr. |
| 6,709,266 | B2 | 3/2004 | Jensen |
| 6,730,137 | B2 | 5/2004 | Pesu et al. |
| 6,733,279 | B2 | 5/2004 | Thigpen et al. |
| D491,288 | S | 6/2004 | Young |
| D493,548 | S | 7/2004 | Goldman |
| D495,437 | S | 8/2004 | Barbera |
| D495,438 | S | 8/2004 | Barbera et al. |
| 6,769,905 | B2 | 8/2004 | Gray et al. |
| 6,780,382 | B2 | 8/2004 | Furner |
| 6,793,484 | B2 * | 9/2004 | Pesu et al. ..... 431/35 |
| D497,680 | S | 10/2004 | McMinn |
| 6,802,707 | B2 | 10/2004 | Furner |
| 6,808,388 | B2 | 10/2004 | Lee |
| 6,849,240 | B2 | 2/2005 | Nakatsu et al. |
| 6,857,869 | B1 | 2/2005 | Sun |
| 6,863,525 | B2 | 3/2005 | Byrd |
| 6,923,639 | B2 | 8/2005 | Pesu et al. |
| 2001/0031438 | A1 | 10/2001 | Hannington et al. |
| 2002/0066789 | A1 | 6/2002 | Yen |
| 2002/0068009 | A1 | 6/2002 | Laudamiel-Pellet |
| 2002/0068010 | A1 | 6/2002 | Laudamiel-Pellet |
| 2002/0093834 | A1 | 7/2002 | Yu |
| 2002/0102187 | A1 | 8/2002 | Bellenger et al. |
| 2002/0119413 | A1 | 8/2002 | Cheng |
| 2002/0127507 | A1 | 9/2002 | Long |
| 2003/0027091 | A1 | 2/2003 | Brandt |
| 2003/0064336 | A1 | 4/2003 | Welch |
| 2003/0134246 | A1 | 7/2003 | Gray et al. |
| 2003/0162142 | A1 | 8/2003 | Bennetts et al. |
| 2003/0175148 | A1 | 9/2003 | Kvietok |
| 2004/0007787 | A1 | 1/2004 | Kvietok |
| 2004/0009103 | A1 | 1/2004 | Westring |
| 2004/0009447 | A1 | 1/2004 | Decker |
| 2004/0016818 | A1 | 1/2004 | Murdell |
| 2004/0028551 | A1 | 2/2004 | Kvietok |
| 2004/0029061 | A1 | 2/2004 | Dibnah et al. |
| 2004/0033171 | A1 | 2/2004 | Kvietok |
| 2004/0033463 | A1 | 2/2004 | Pesu et al. |
| 2004/0128879 | A1 | 7/2004 | Lu |
| 2004/0160764 | A1 | 8/2004 | Lee |
| 2004/0223871 | A1 | 11/2004 | Woo |
| 2004/0223943 | A1 | 11/2004 | Woo |
| 2004/0229180 | A1 | 11/2004 | Furner |
| 2004/0241053 | A1 | 12/2004 | Thompson |
| 2004/0265164 | A1 | 12/2004 | Woo |
| 2005/0019238 | A1 | 1/2005 | Hart et al. |
| 2005/0037306 | A1 | 2/2005 | Nakatsu |
| 2005/0079463 | A1 | 4/2005 | Yu |
| 2006/0057521 | A1 | 3/2006 | Kubicek et al. |
| 2006/0057522 | A1 | 3/2006 | Kubicek et al. |
| 2006/0057523 | A1 | 3/2006 | Kubicek et al. |
| 2006/0057526 | A1 | 3/2006 | Kubicek et al. |
| 2006/0057528 | A1 | 3/2006 | Kubicek et al. |
| 2006/0084021 | A1 | 4/2006 | Kubicek |
| 2006/0183065 | A1 | 8/2006 | Konkle, Jr. |

FOREIGN PATENT DOCUMENTS

| | | |
|---|---|---|
| DE | 3302591 | 8/1984 |
| DE | 3403604 | 8/1985 |
| DE | 4203644 | 8/1993 |
| DE | 4241292 | 5/1994 |
| DE | 4314122 | 11/1994 |
| DE | 195 48 958 | 5/1996 |
| DE | 195 08 962 | 9/1996 |
| DE | 102004011919 | 6/2005 |
| EP | 0146247 | 6/1985 |
| EP | 1054054 | 11/2000 |
| EP | 1 336 799 | 8/2003 |
| FR | 2628825 | 3/1988 |
| GB | 161342 | 4/1921 |
| GB | 1514338 | 6/1978 |
| GB | 2 239 942 | 7/1991 |
| JP | 362220594 | 9/1987 |
| JP | 406212189 | 8/1994 |

| | | |
|---|---|---|
| JP | 408185710 | 7/1996 |
| JP | 2003-213292 | 7/2003 |
| WO | WO 89/06141 | 7/1989 |
| WO | WO 95/12783 | 5/1995 |
| WO | WO 96/02794 | 2/1996 |
| WO | WO 99/17055 | 4/1999 |
| WO | WO 99/45322 | 9/1999 |
| WO | WO 01/46618 | 6/2001 |
| WO | WO 2004/ 008026 | 1/2004 |
| WO | WO 2004/083349 | 9/2004 |
| WO | WO 2004/083718 | 9/2004 |
| WO | WO 2004/090417 | 10/2004 |

OTHER PUBLICATIONS

Intl. Search Report dated Jul. 27, 2006, Appl. No. PCT/US 2005/032266 (4033 PCT).
U.S. Appl. No. 09/742,631, Office Action dated Aug. 18, 2003.
U.S. Appl. No. 09/747,525, Office Action dated Sep. 9, 2003.
U.S. Appl. No. 09/747,525, Office Action dated May 20, 2003.
U.S. Appl. No. 09/747,525, Office Action dated Jan. 10, 2003.
U.S. Appl. No. 09/747,525, Office Action dated Jul. 2, 2002.
U.S. Appl. No. 09/747,525, Office Action dated Oct. 1, 2001.
U.S. Appl. No. 10/780,028, Office Action dated Oct. 4, 2006.
U.S. Appl. No. 10/780,028, Office Action dated Apr. 11, 2006.
U.S. Appl. No. 10/780,028, Office Action dated Oct. 18, 2006.
U.S. Appl. No. 10/938,434, Office Action dated Jul. 17, 2006.
U.S. Appl. No. 10/978,744, Office Action dated Jul. 19, 2006.
U.S. Appl. No. 10/978,646, Office Action dated Aug. 3, 2006.
U.S. Appl. No. 10/978,744, Final Office Action dated Nov. 13, 2006.
U.S. Appl. No. 10/938,434, Final Office Action dated Nov. 20, 2006.
International Candle House catalog (1966-67); Bobeshes pp. 54-55.
Pourette Catalog 1998; p. 12.
Prices London Candlemakers; http:www.prices-candles.co.uk/mainpage.htm; 1 page; printed Apr. 21, 2005.
Prices London Candlemakers; http:www.prices-candles.co.uk/catalogue/Accessories/Accessories%20Page%2008.jpg; 1 page; printed Apr. 21, 2005.
Two (2) photos of Price's "Coral Bay Fragranced Bathroom" product taken Jan. 1, 1999.
Stephanie Reiser Wrought Iron—" Welcome to CourtingCandle.com!" http://www/courtingcandle.com; 1 page printed on May 12, 2004.
Intl. Search Report and Written Opinion dated Mar. 13, 2007, Appl. No. PCT/US2006/042787 (J-4471).
Intl. Search Report and Written Opinion dated Mar. 21, 2007, Appl. No. PCT/US2006/046057 (J-4401).
U.S. Appl. No. 11/123,372, Office Action dated Feb. 27, 2007.
U.S. Appl. No. 11/123,461, Office Action dated Mar. 7, 2007.
U.S. Appl. No. 11/123,809, Office Action dated Mar. 7, 2007.
U.S. Appl. No. 10/978,646, Office Action dated May 4, 2007.
Office Action in U.S. Appl. No. 10/978,646, dated May 4, 2007

* cited by examiner

WICK HOLDER AND WICK ASSEMBLY FOR CANDLE ASSEMBLY

CROSS REFERENCE TO RELATED APPLICATIONS

This application is a continuation-in-part of U.S. patent application Ser. No. 10/978,744, filed Nov. 1, 2004, now U.S. Pat. No. 7,229,280 which is a continuation-in-part of U.S. patent application Ser. No. 10/938,434, filed Sep. 10, 2004.

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to candles, and more specifically to a candle having a fuel element and a wick clip.

2. Description of the Background of the Invention

Clips that locate and secure wicks for candles and for devices that dispense vapors into the ambient air are well known in the art, and useful in many applications. In candles, such clips may be used to position the wick for the most efficient provision of fuel, such as candle wax, to the flame, while in vapor dispensing devices, such wick clips secure a wick by which a vaporizable liquid is delivered from a reservoir to an exposed surface.

More recently, melting plate candles and simmer plate dispensers have been used to provide rapid melting of a solid fuel element and/or rapid dispensing of a vaporizable material to the atmosphere. In one melting plate candle, a dispenser for active materials has a melting plate dispenser of volatile materials comprising a wax fuel element, a consumable wick disposed in the wax fuel element, and a heat conductive base having conductive elements. Heat from a flame at the wick is transferred to the heat conductive base, which in turn helps melt the wax fuel element at locations other than directly adjacent to the flame. Another melting plate candle has a concave melting plate. A wick in a fuel element is located at a low point in the melting plate such that melted fuel material on the melting plate is directed by gravity toward the wick.

In each of the aforementioned melting plate candles, the melted wax is allowed to flow up the wick by uncontrolled capillary action, which may cause the candle to burn brighter than necessary or consume the wax faster than desired.

SUMMARY OF THE INVENTION

In one aspect of the invention, a wick assembly includes an enclosed wick casing that extends between a first open end and a second open end and a wick extending between the first open end and the second open end with at least a portion of the wick surrounded by the wick casing. The wick assembly further includes a base portion at the first open end, wherein the base portion includes a peripheral skirt that projects outwardly and downwardly from the wick casing and a textured inner surface that is shaped and sized to conform closely around an upwardly projecting pedestal.A restricted portion of the wick casing has a cross sectional area less than a cross sectional area of either the first open end or the second open end, and the restricted portion of the wick casing reduces an effective capillary flow capacity along the wick.

In another aspect of the invention, a wick holder includes an elongate enclosed wick casing extending from a base portion. The wick casing has a first open end and a second open end. The base portion includes an end wall and a down-turned annular skirt extending from the end wall in an opposite direction from the wick casing. The annular skirt has a textured inner surface that is shaped and located to maintain a capillary space between the annular skirt and an upward projection surrounded by the annular skirt. A constricted portion of the wick casing restricts an effective capillary fluid flow capacity between opposite open ends of the wick casing.

In yet another aspect of the invention, a wick assembly includes a tube having a sidewall extending between a first open end and a second open end and a base at one end of the tube for supporting the tube in a substantially vertical position. The base portion includes a peripheral skirt that projects outwardly and downwardly from the tube and a textured inner surface that is shaped and sized to conform closely around an upwardly projecting pedestal. A wick is at least partly disposed in the tube and extends between the first open end and the second open end.

These and other aspects of the invention will become apparent in light of the following detailed description, in which:

DETAILED DESCRIPTION

Figure 1:
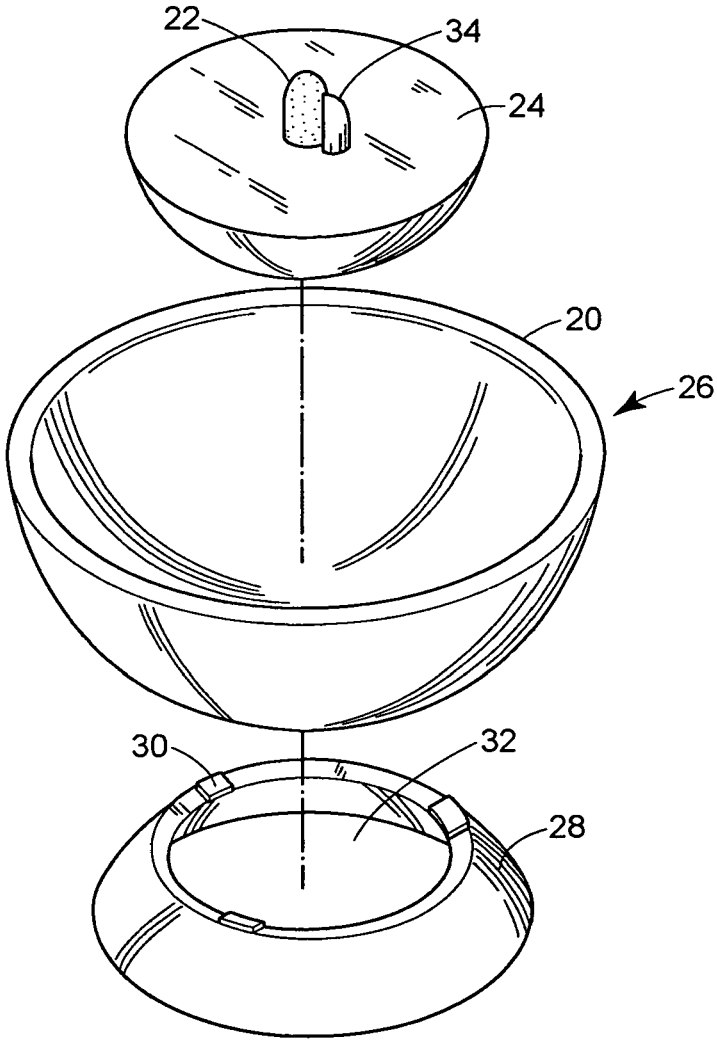
FIG. 1 illustrates a melting plate candle of the prior art, in simplified isometric view.
Figure 2:
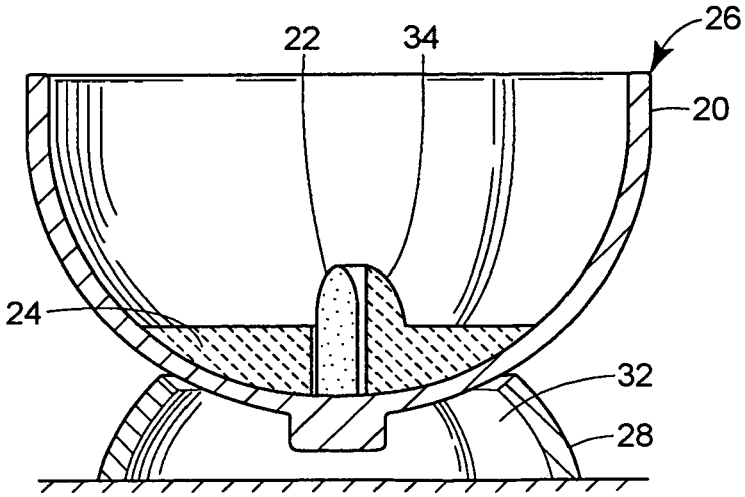
FIG. 2 illustrates the melting plate candle of FIG. 1, in simplified cross-section.

Turning now to the drawings, FIGS. 1 and 2 illustrate a melting plate candle in its most basic form, such as set forth in Furner et al. U.S. Pat. No. 6,802,707, issued Oct. 12, 2004, and incorporated herein in its entirety by reference. As illustrated, a heat conductive container, such as a melting plate 20, is provided, which transfers heat obtained from the heat source, a flame (not shown) located on wick 22 by means of heat conduction, to a solid fuel element 24, which rests upon a top surface of the melting plate. For purposes of illustration, and for clarity, but intending no limitation, the wick 22 is illustrated as being of a relatively large diameter, rather than as a fibrous wick of small diameter. The wick 22 is positioned within and engages the solid fuel element 24, such as with a wick clip (not shown in FIGS. 1 and 2). The melting plate 20 as shown in FIGS. 1 and 2, is heated directly by a flame on the wick 22 by radiation as a result of the melting plate being bowl-shaped so as to have a portion, such as outer shoulder 26, in relative proximity to the flame, the diameter of the melting plate being such as to permit inner surfaces thereof to absorb appreciable amounts of heat from the flame.

The melting plate of FIGS. 1 and 2 is shaped with the outer shoulder 26 raised in order to contain a resultant pool of melted fuel. The melting plate 20 may be in the form of a tray, bowl, concave plate, or other configuration, which is capable of holding a pool of hot liquid fuel, and is shaped in one embodiment so as to funnel or channel the liquefied (e.g., melted) fuel to the wick. The melting plate 20 may constitute a container in itself, as shown, or may be surrounded by a separate container. In the embodiment shown in FIGS. 1 and 2, the melting plate rests upon a non-conductive base 28 or legs of non-conductive or insulating material, so as to permit placement upon a table, counter, or other surface. The non-conductive base, as illustrated, comprises contact points 30 so as to minimize the amount of contact between the base and the melting plate, and to create an insulating air gap 32 between the melting plate and the surface upon which the assembly rests.

The melting plate 20 may be of any heat conductive material, such as brass, aluminum, steel, copper, stainless steel, silver, tin, bronze, zinc, iron, clad materials, heat conductive polymers, ceramics, glass, or any other suitable heat conductive material or combination of such materials. As shown in FIG. 2, the fuel element 24 is preferably located in direct contact with the top surface of the melting plate 20, which plate may, if desired, be constructed so as to have a non-conductive lower surface, so that the melting plate may rest upon a table surface or such. Such a configuration may result from a clad material, a conductive melting plate material coated on the surface of a non-conductive material, a non-conductive material having an insert of a heat conductive material, or other suitable arrangements to permit the melting plate to be cool enough on the bottom surface to permit ease of handling, and/or placement upon surfaces not suitable for contact with heated bodies.

The wick 22 in one embodiment constitutes a conventional consumable wicking material, such as cotton, cellulose, nylon, or paper, or the like, which by capillary action carries liquid fuel to the flame. In another embodiment, non-consumable wicks may comprise such materials as porous ceramics; porous metals; fiber glass; metal fiber; compressed sand, glass, metal, or ceramic microspheres; foamed or porous glass, either natural or man-made, such as pumice or perlite; gypsum; and/or chalk. The wick 22 may be located in the center of the melting plate 20 or may be off-center as desired, provided that the melting plate is configured so as to channel or funnel melted fuel to said wick. As illustrated, the wick 22 may be positioned in conjunction with a starter bump 34 of wax in the top surface of the fuel element 24 for ease of lighting. The presence of two or more wicks is also within the scope of the present invention. The wick 22 is provided in conjunction with a wick clip or, wick holder assembly, one embodiment of the wick holder assembly being such as to cooperatively engage a complimentarily shaped capillary pedestal 36 on the melting plate 20, as shown in FIGS. 3, 4, and 5, discussed hereinafter.

Figure 3:
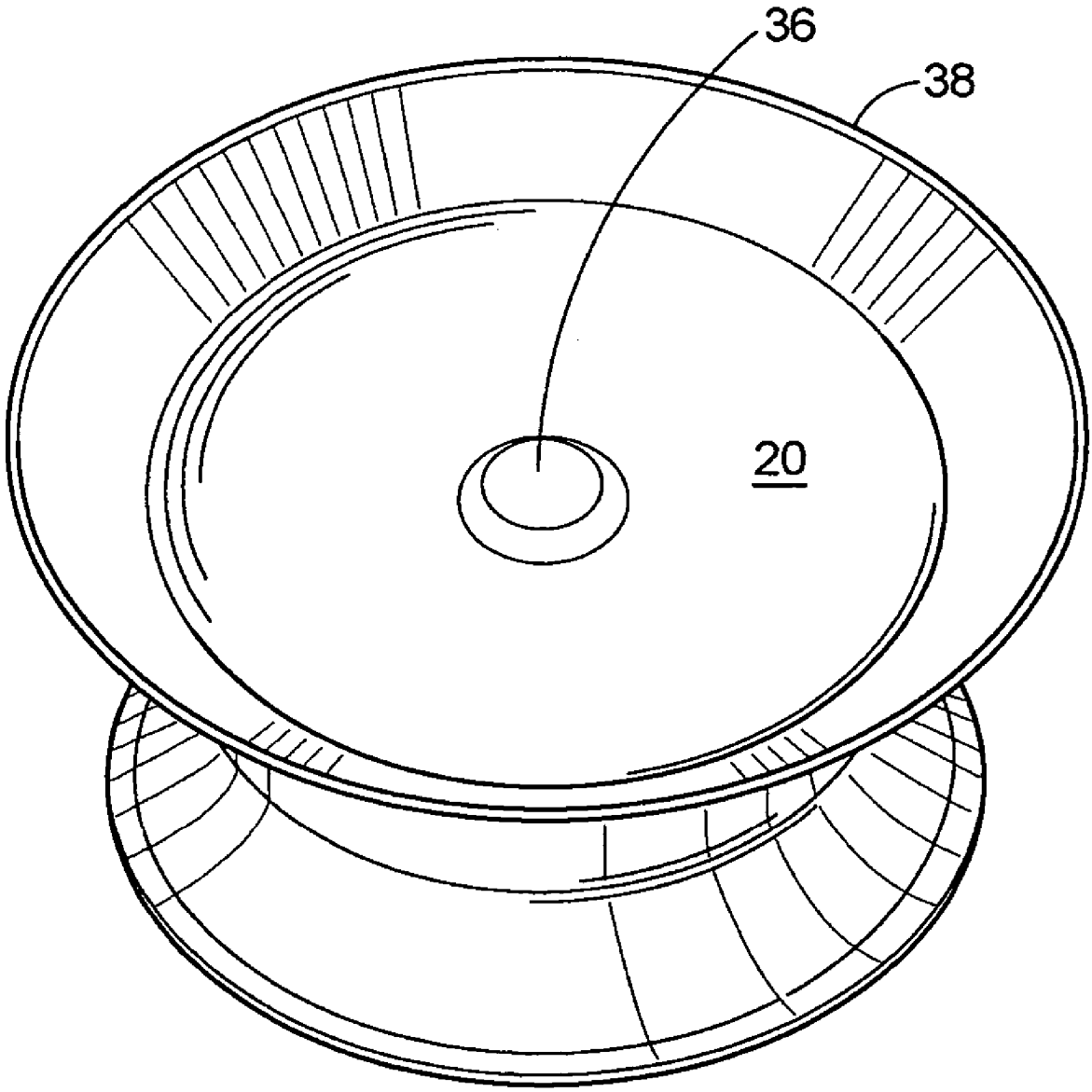
FIG. 3 is a simplified isometric view of a melting plate candle holder, including a melting plate and a capillary pedestal.

FIG. 3 is a simplified perspective view of a melting plate candle holder 38, showing the capillary pedestal 36, but absent the wick holder assembly and a candle. The candleholder 38 is of a decorative shape, which may be of any suitable shape for the use intended, with an open top for placement of a fuel element (not shown) and the wick holder assembly upon a melting plate 20. The melting plate in turn has a raised area, or pedestal 36, near the center of the melting plate 20, upon which the wick holder assembly may be positioned. As shown, the candleholder 38 has a bowl-like configuration, with raised edges to confine and hold a liquefied fuel. The melting plate 20, as previously indicated, may be of any heat conductive material, for example, a material such as aluminum, and may be bonded adhesively to the surface of the candleholder by conventional means, or may be otherwise held in position.

Figure 4:
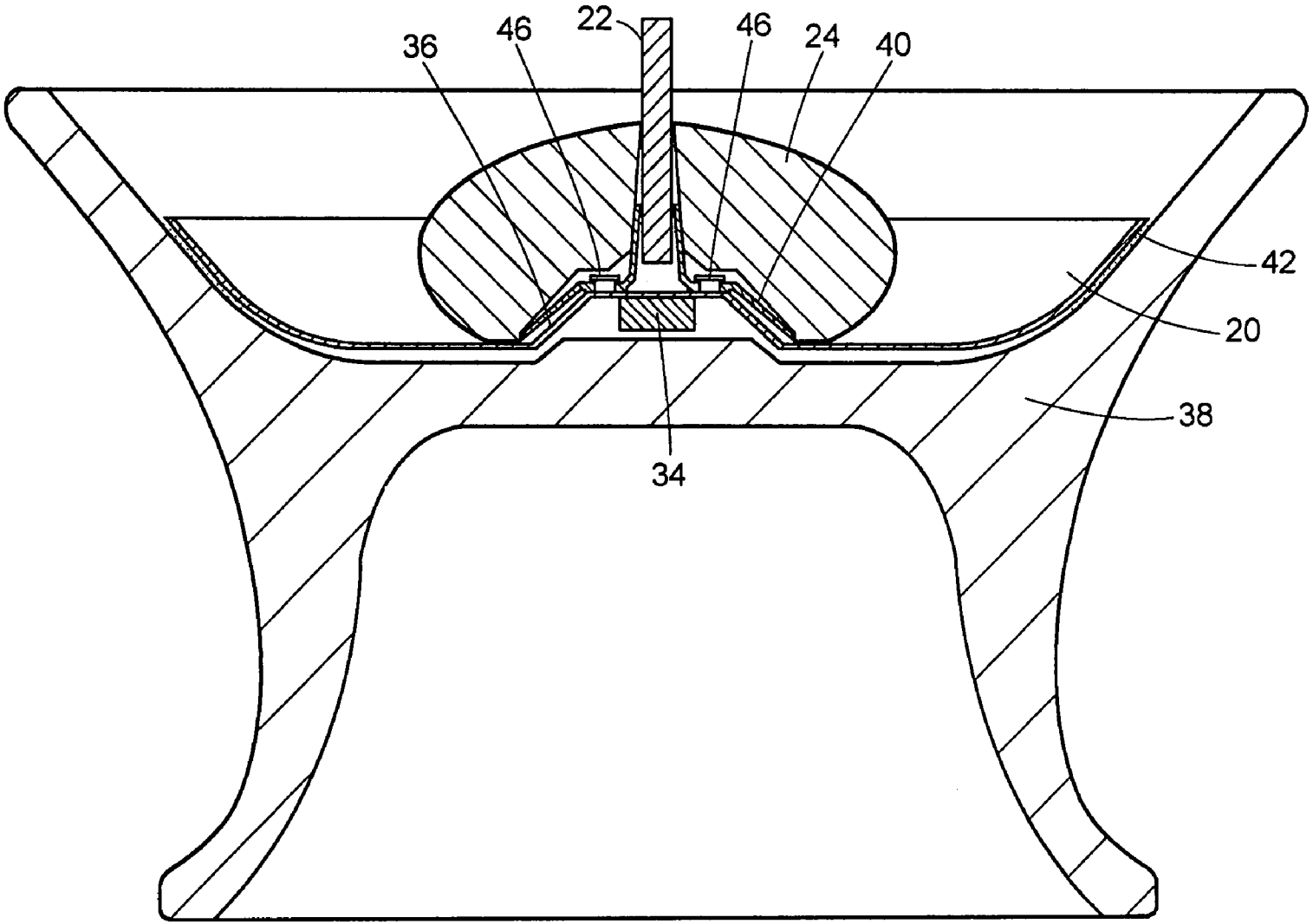
FIG. 4 is a cross-sectional view of one embodiment of a melting plate candle of the present invention, showing a candle holder, a melting plate, a wick clip assembly, and a fuel element in an assembled position according to one aspect of the present invention.

FIG. 4 is a cross sectional view of one embodiment of a melting plate candle, showing a candle holder 38, a melting plate 20, a wick clip assembly, or wick holder 40, and a fuel element 24 in a assembled position. As may be seen, the candleholder 38 is of a decorative configuration, and may be of any material, such as glass, metal, plastic, wood, ceramic, or other material suitable for the intended use. The melting plate 20 constitutes a bowl-like structure held in place in the candleholder 38 by adhesive 42. In one embodiment, the melting plate is aluminum, which may have a decorative design embossed, printed, engraved, etched, or carved into a surface thereof. At or near the center of the melting plate 20, and thus the candleholder, a raised pedestal 36 is positioned to engage the wick holder 40. The wick holder 40 is adapted to hold and position a wick 22 in an appropriate position and location. Beneath the pedestal 36 is positioned a magnet 44 adhesively held to the bottom of the melting plate 20. Alternatively, the magnet 44 may be positioned, either loosely or adhesively or otherwise held, upon the surface of the candleholder beneath the pedestal. The wick holder 40 is positioned over the pedestal 36 so as to engage the pedestal and to provide a capillary flow of melted wax to a base of the wick 22. To provide retention of the wick holder 40 on the pedestal 36, the wick holder 40 encompasses one or more magnetic metal inserts 46, such as rivets, to engage the magnet force of the magnet 44 located below the pedestal. Such magnetic metal inserts 46 may be of any material that is attracted magnetically to the magnet, and may alternatively constitute metal screws, rivets, clips, etc. The fuel element 24 is positioned so as to cooperatively engage both the melting plate 20 and the wick holder 40.

Figure 5:
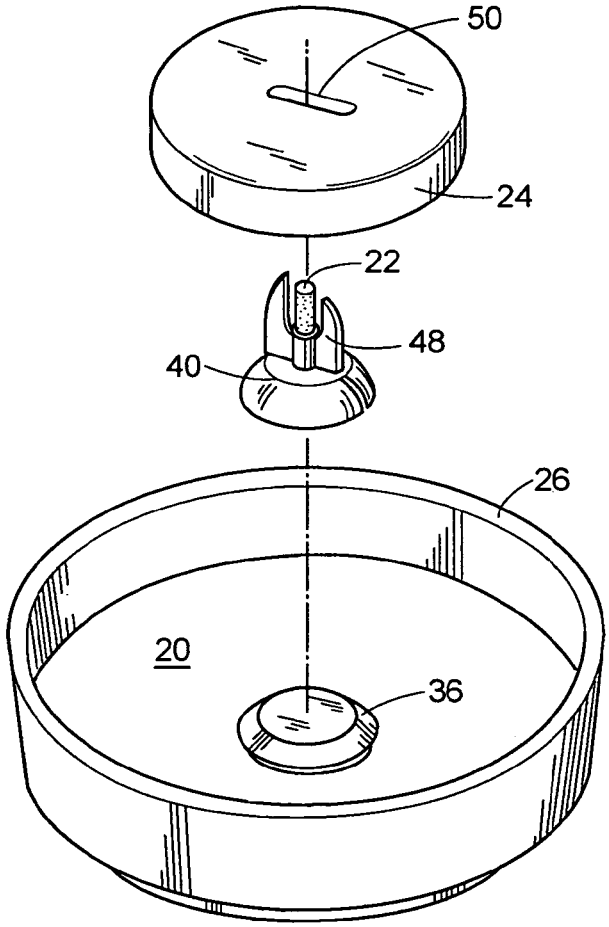
FIG. 5 is an exploded isometric view of a melting plate having a capillary pedestal, with a wick holder with fins and incorporated wick, and a fuel element.

In FIG. 5, an exploded perspective view of another embodiment is shown with a bowl-shaped melting plate 20, which includes a capillary pedestal 36 located approximately in the center thereof. A wick holder 40 is shown above the capillary pedestal 36, the wick holder being shaped in such a manner as to fit closely over the capillary pedestal, and to magnetically engage the pedestal so as to be locked in position. The wick holder 40 also includes a wick 22 and a heat transfer element, such as a heat fin 48. A solid fuel element 24 has a cut out portion 50 through which the heat fin 48 and wick 22 may pass, so as to place the wick in close proximity to a top surface of the fuel element. The solid fuel element 24 is shown as a wax puck, although other shapes may be used within the scope of the present invention. Since difficulty in lighting the wick 22 may be encountered, a starter formation of fuel, such as the starter bump 34 shown in FIGS. 1 and 2, may be provided in close proximity to the wick 22. As illustrated in FIGS. 1 and 2, the starter bump 34 is most easily molded directly into the shape of the fuel element 24 and provides a ready source of liquid fuel to the wick 22 when a match or other appropriate source of flame is employed to start the wick burning, which source of flame will melt the starter bump 34 to thus create an initial pool of liquid fuel.

Figure 6:
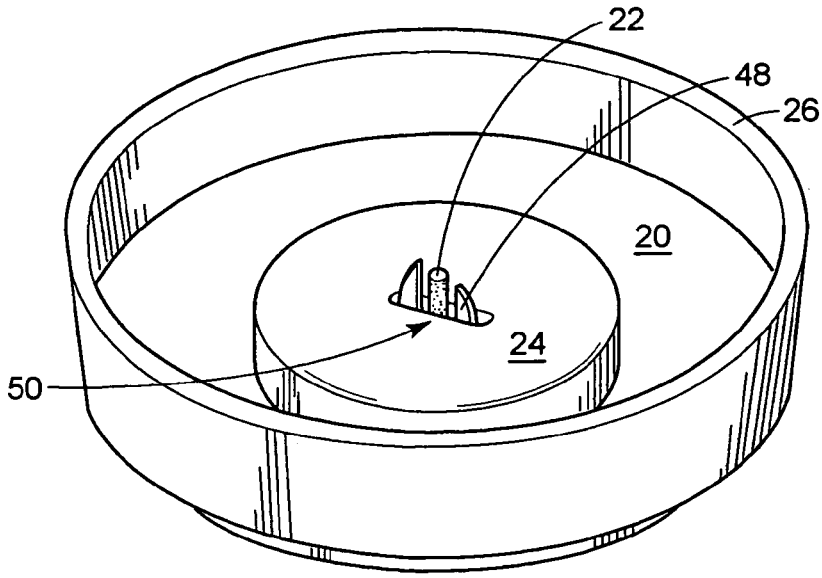
FIG. 6 is an isometric view of the assembled melting plate, wick holder, and fuel element of FIG. 5.
Figure 7:
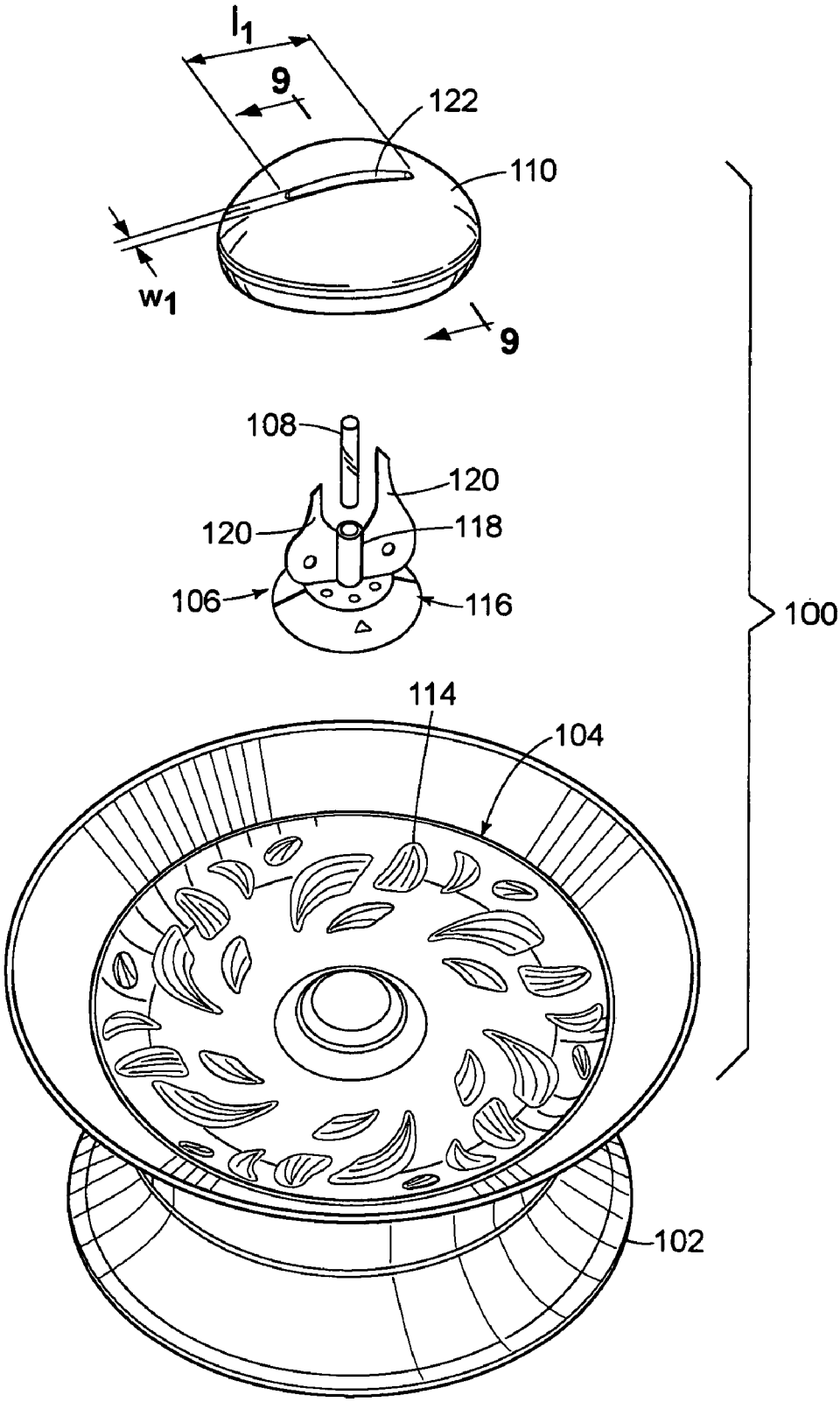
FIG. 7 is an exploded isometric view of a candle assembly according to another aspect of the present invention.

In FIG. 6, the melting plate candle of FIG. 4 is shown in a assembled operational configuration, showing the relationship of the elements in position for lighting or ignition of the wick 22. The melting plate 20 is shown with the fuel element 24 positioned on the capillary pedestal 36 (not visible) and centered around the wick holder 40 with the heat fin 48 and wick 22 extending through the opening 50. Additional advantages and details of a similar capillary pedestal are discussed in U.S. patent application Ser. No. 10/780,028, filed Feb. 17, 2004, which is incorporated herein by reference in its entirety, and which discloses a melting plate candle having a solid fuel element, a melting plate, and a lobe which engages a wick holder for a wick, wherein the wick holder engages the lobe in such a manner as to create a capillary flow of melted fuel to the wick.

Thus, when using a solid fuel, such as wax, in conjunction with a heat conductive wick holder 40, solid fuel refill units similar to the fuel element 24 may be shaped to fit a shape of the melting plate 20, with a specific relationship to the wick holder, which itself is engaged with the melting plate 20 by, for example, magnetic forces. For example, the melting plate 20 may be a decoratively shaped container, and wax may be provided in the form of fuel element refill units specific for the container shape selected, such as round, square, oval, rectangular, triangular, or otherwise, so shaped that the wick holder assembly incorporated with the fuel element refill unit will fit and engage a complementarily shaped capillary pedestal 36.

The use of a melting plate 20 with additional heat conductive elements, such as the heat fins 48, offers a number of distinct advantages. First, it permits a larger pool of liquid fuel, due to improved heat conduction into the fuel, which results in more rapid formation of the pool. This in turn allows better regulation of the size and shape, as well as the temperature, volume, and depth of the liquefied wax pool to allow more efficient use of fuels present. For example, melting plates of the present invention permit ease of refill, with little or no cleaning. In most instances, no cleaning is required, but if desired, the melting plate 20 may be conveniently washed in a manner such as a dish, plate, or bowl is washed, in a wash basin or in a dishwasher. The use of a capillary pedestal 36 in the heat plate 20, in conjunction with heat fins 48 on the wick holder 40, also reduces or eliminates retention of solidified excess fuel when the candle is allowed to burn itself out, and permits more complete and uniform burning of fuel elements 24 which are other than round, e.g., square, oval, triangular, or in the shape of a flower or decorative object, etc. Further, the melting plate 20, when used in conjunction with a capillary pedestal 36 and complimentary wick holder 40, provides a device which may be self extinguishing, and improves or eliminates typical burning problems encountered with candles, such as tunneling, drowning, collapsing, cratering, and wick drift. Fuel elements, such as candles, utilizing the melting plates described herein are also more forgiving of formulation or process variances. Furthermore, the presence of a magnetic retention assembly to retain the wick holder 40 on the capillary pedestal 36 provides a margin of safety and convenience.

Turning now to FIGS. 7-11, another candle assembly 100, similar to the melting plate candle shown in FIG. 4, includes a support base 102, a melting plate 104, a wick holder 106, a wick 108, and a fuel element 110. The support base 102 carries the melting plate 104, which is generally saucer shaped, and includes a centrally disposed capillary pedestal 112. Optional decorative etchings 114 are disposed on an upper exposed surface of the melting plate 104 to provide enhanced attractiveness or visual information. The wick holder 106 includes a base portion 116 that fits over the capillary pedestal 112, a wick retainer sleeve in the shape of an elongate cylindrical barrel 118, and heat conductive elements, such as fins 120. The barrel 118 receives the wick 108 therein such that the wick extends from the base portion 116 with a portion of the wick exposed above the barrel. The fuel element 110 is disposed over and around the wick holder 106 and includes a duct or slot 122 through which the wick 108 extends. The slot 122 has a width $w_1$ sufficient to allow the wick 108 to extend through the slot and a length $l_1$ sufficient to accept at least a portion of the fins 120 therethrough. In one embodiment, the fuel element 110 has a mass of wax approximately 15 grams, and the melting plate candle 100 burns continuously between about 3 and 3½ hours on a single fuel element, such as the wax fuel element 110, before the fuel is completely consumed.

Figure 8:
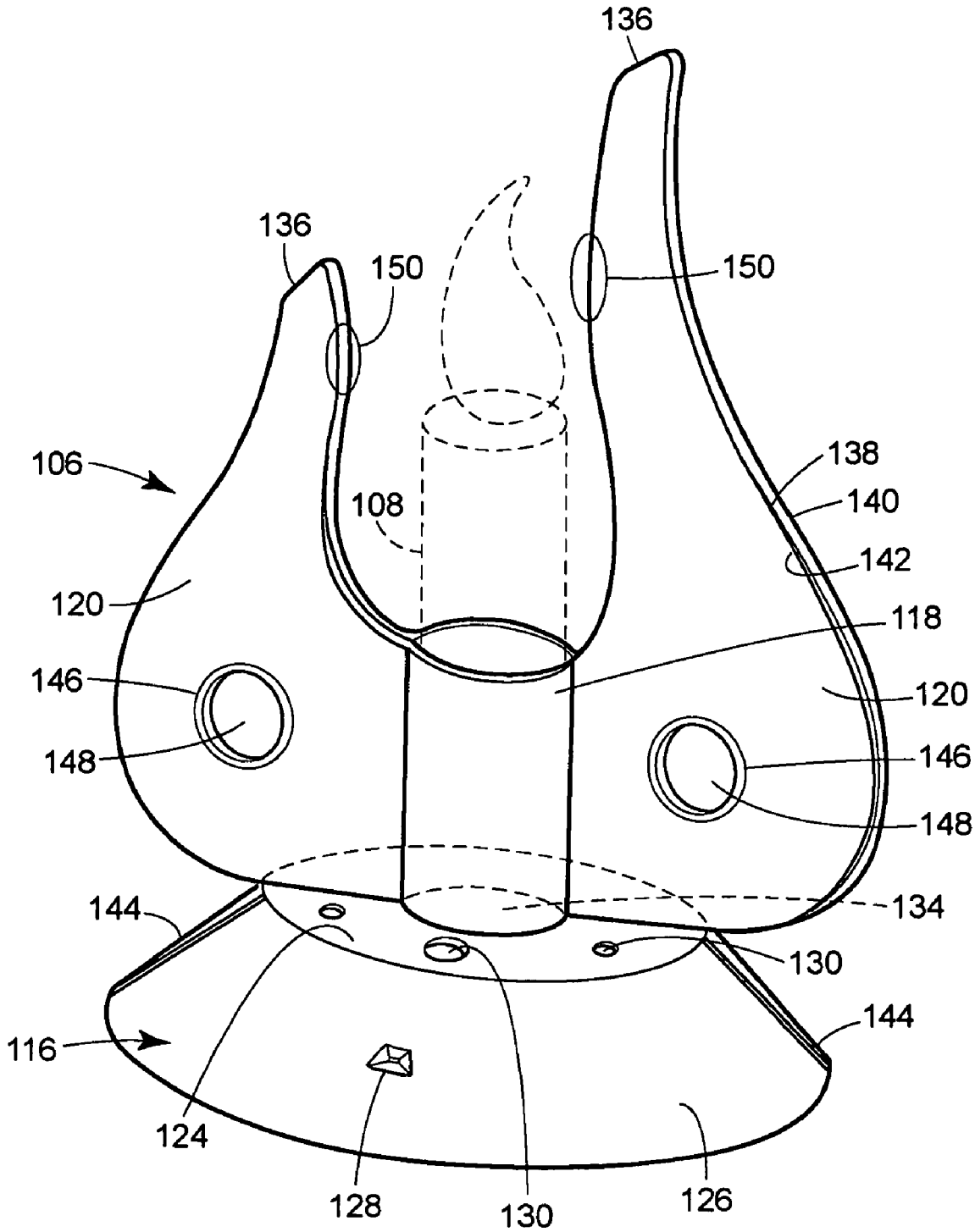
FIG. 8 is an enlarged isometric view of a wick holder shown in FIG. 7.

As seen in FIG. 8, the base portion 116 of the wick holder 106 includes an end plate 124 encompassed by a generally conical base skirt 126, and an upper portion including the barrel 118 extending upwardly from the base skirt and the fins 120 extending from the barrel and end plate 124. The base portion 116 is adapted to fit closely over and around the capillary pedestal 112 such that the barrel 118 is maintained in an upright, or substantially vertical, orientation when placed on the capillary pedestal. The base skirt 126 includes indentations or spacers 128, and holes 130 extend through the end plate 124. Ferromagnetic structures, such as steel rivets 132 or magnets (not shown), are secured to the base portion 116, such as through the holes 130, so that the wick holder 106 may be releasably secured over the capillary pedestal 130 by magnetic forces. The barrel 118 is sized to receive the wick 108 with either a close fit or an interference fit so as to retain the wick therein and defines an opening 134 in the end plate 124 such that the wick can extend through the end plate. The fins 120 extend laterally outwardly on opposite sides of the barrel 118 and extend upwardly above the barrel. In one embodiment, the fins 120 are shaped to simulate a flame outline. In other embodiments, the fins 120 may have square, circular, oval, triangular, or other non-geometric shapes, and in still other embodiments, the fins 120 may have insulated areas (not shown) as described more fully in U.S. patent application Ser. No. 10/939,039, filed Sep. 10, 2004, and incorporated herein by reference in its entirety. The fins 120 are relatively thin strips of heat conductive material, such as metal, for transmitting heat from a flame burning on the wick 108 outwardly toward the fuel element 110. In one embodiment, the wick holder 106 is formed from a single sheet of aluminum that is cut and folded about a fold 136 and thereby forming a capillary space 138 between opposite sides 140 and 142 and channels or gaps 144 in the base skirt 126. In other embodiments, the wick holder 106 may be formed by other methods from other heat resistant materials, such as ceramic, other metals, heat resistant plastics, etc. If the wick holder 106 is formed of a ferromagnetic material, such as steel, the steel rivets 132 may optionally be omitted. The two sides 140 and 142 are secured together by any convenient means, such as with rivets 146 through holes 134 in the heat fins 120, welds, clips, heat resistant adhesives, etc. The gaps 144 and the holes 130 allow melted fuel material from the fuel element 110, to drip or seep underneath the base skirt 126, and the capillary space 138 allows melted fuel material to traverse up the fins 120 by capillary action and thereby provide a source of fuel material in non-consumable wick areas 150. An example of such capillary action is described in U.S. patent application Ser. No. 10/938,453, filed Sep. 10, 2004, and incorporated herein by reference in its entirety.

Figure 9:
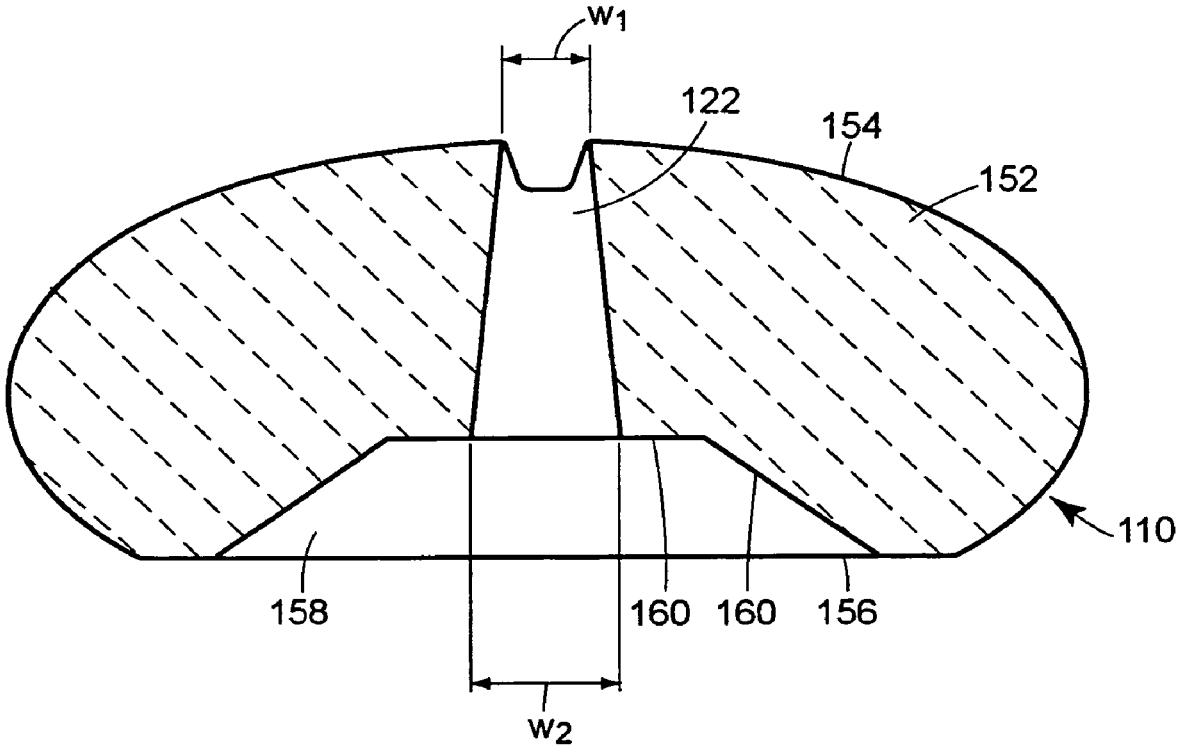
FIG. 9 is a cross-sectional view of a fuel element along the line 9-9 of FIG. 7.

As seen in detail in FIG. 9, the fuel element 110 includes a body 152 of fuel material and has an upper surface 154 and a lower surface 156. The fuel element 110 in one embodiment is a wax puck and in other embodiments may have other shapes and include other meltable or flowable fuel materials, such as paraffin or animal fat, having a solid or semi-solid state or otherwise maintainable in a fixed form at room temperature. The lower surface 156 of the fuel element 110 defines a cavity 158 having an upper cavity wall 160 shaped to conform closely to the base portion 116 of the wick holder 106. The slot 122 extends from the upper surface 154 to the cavity wall 160 and has a width $w_1$ at the upper surface that is smaller than a width $w_2$ at the cavity wall. The width $w_1$ is adapted to prevent melted wax from the fuel element 110 from falling or trickling down the slot 122 without engaging the wick 108, or put another way, the width $w_1$ is narrow enough to ensure that melted fuel material from near the upper portion of the slot 122 will engage the wick 108 as it falls or trickles down the slot. In one embodiment, $w_1$ is not more than approximately 0.02" (0.5 mm) larger than a diameter of the wick at an upper end of the slot 122. In another embodiment, $w_1$ is approximately the same as a diameter of the wick 108. In yet another embodiment, the width $w_1$ is less than a width of the wick 108 so that an interference fit exists between the wick and the body 152 at the upper end of the slot 122. In a further embodiment, the width $w_1$ is less than or equal to approximately 0.12" (3 mm), and the wick 108 has a diameter of approximately 0.1" (2.5 mm). In yet a further embodiment (not shown), the slot 122 may have a width that is initially more than 0.02" (0.5 mm) larger than a diameter of the wick 108 to allow for easy insertion of the wick 108 and wick holder 106 into the slot 122, and the slot is filled subsequently with additional fuel material in a second manufacturing step so that the width $w_1$ is less than 0.02" (0.5 mm) larger than the diameter of the wick. Having a slot width $w_1$ as described herein helps ensure successful initial lighting and sustained burn of the wick 108 at a higher success rate than with a slot width that is larger. The slot width $w_1$ as described herein also reduces or eliminates the need for a starter bump to provide fuel to the flame and wick during the initial ignition and sustained burn of the candle. The larger width $w_2$ at the cavity wall 160 facilitates easily inserting the wick holder 106 and the wick 108 into the slot 122, and the cavity 158 and cavity wall 160 help conceal the wick barrel 118 and base skirt 126 and ensure proper placement of the fuel element 110 around and along the wick holder 106. The widths $w_1$ and $w_2$ also provide a convenient way to ensure that the wick holder 106 is inserted correctly into the slot 122 in a predetermined spatial relationship.

Figure 10:
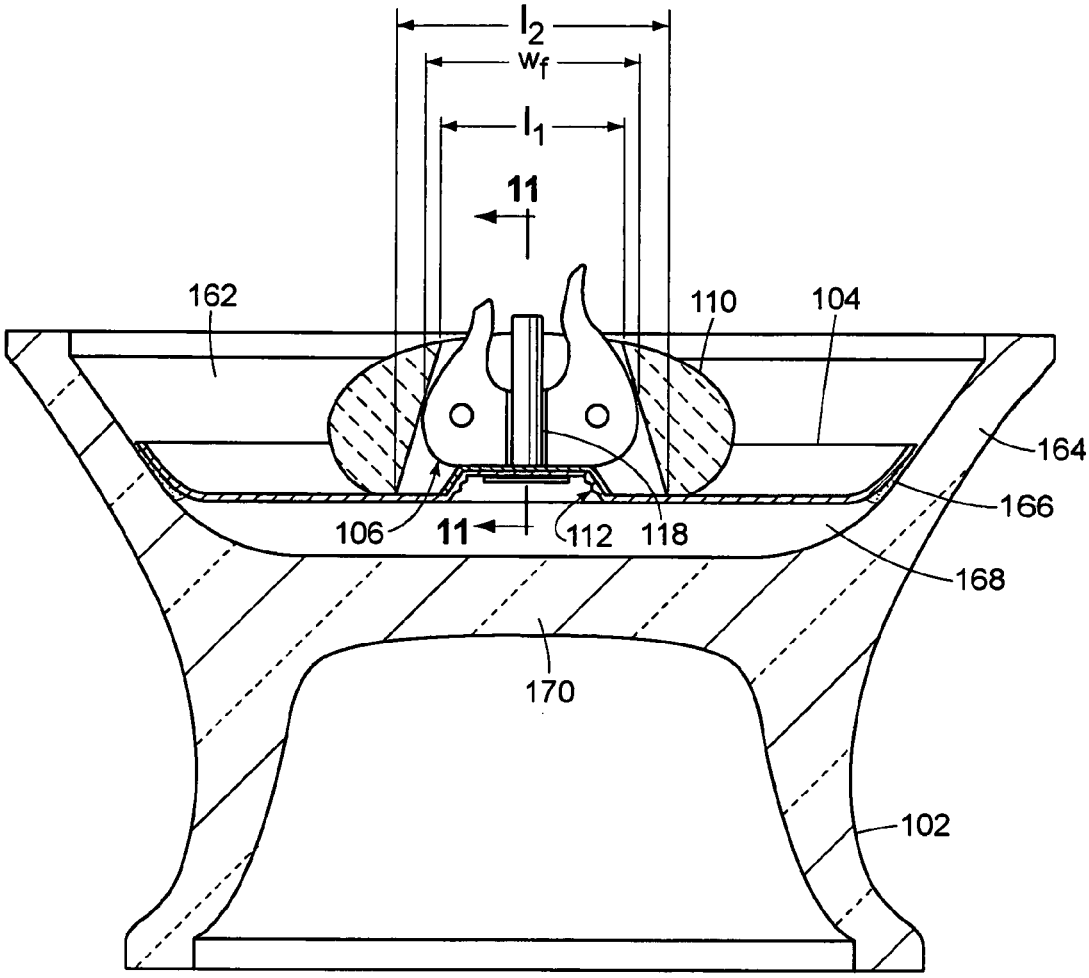
FIG. 10 is a cross-sectional view generally transverse to line 9-9 of FIG. 7 with the candle assembly in assembled form.

As shown in FIG. 10, the support base 102 carries the melting plate 104 within an upper chamber 162, which is generally bowl-shaped. The melting plate 104 in one embodiment is secured to a sidewall 164 of the upper chamber 162 with adhesive 166 thereby providing an empty air space 168 between the melting plate and an intermediate wall 170 of the support base 102. The air space 168 provides additional insulation between the melting plate and the support base 102 to reduce heat loss through the melting plate to the support base. In another embodiment (not shown) the melting plate 104 is adjacent to the intermediate wall 170 with adhesive 166 placed therebetween such that no air space 168 is disposed between melting plate and the intermediate wall. Of course, other arrangements and support configurations for the melting plate 104 are also suitable for supporting the melting plate 104.

In one embodiment of the fuel element 110, the slot 122 has a length $l_1$ in the upper surface 154 that is longer than a length $l_2$ in the lower surface 156. The length $l_1$ is shorter than a largest width $w_f$ of the fins 120 and the length $l_2$ is longer than the largest width $w_f$ of the heat fins. Such a configuration of the slot lengths $l_1$ and $l_2$ in relation to $w_f$, in addition to the slot widths $w_1$ and $w_2$ as described herein above, facilitates easily inserting the wick holder 106 fully into the slot from the lower surface 156. Such configuration of the slot 122 and cavity 158 also prevents the slot from fully receiving the wick holder if the fins 120 are inserted into the slot through the upper surface 154 rather than through the lower surface 156, thereby preventing or discouraging improper assembly of the fuel element 110 and the wick holder 106.

Although a slot 122 has been described in particular, ducts having shapes other than slotted are also contemplated that facilitate inserting the wick 108 through the fuel element 110 and immersing the wick in melted or flowing fuel material traveling down the duct. For example, the duct may have the shape of a cone if the wick holder 106 does not include any fins 120 extending outwardly from the barrel 118. In another example, the duct may have a square, rectangular, triangular, or other non-geometric shape that is adapted to allow the wick 108 to pass through the fuel element 110 and accommodate insertion of any structures of the wick holder 106 that surround or extend from the wick and may be, for example, funnel shaped, substantially cylindrical, and/or curved.

Figure 11:
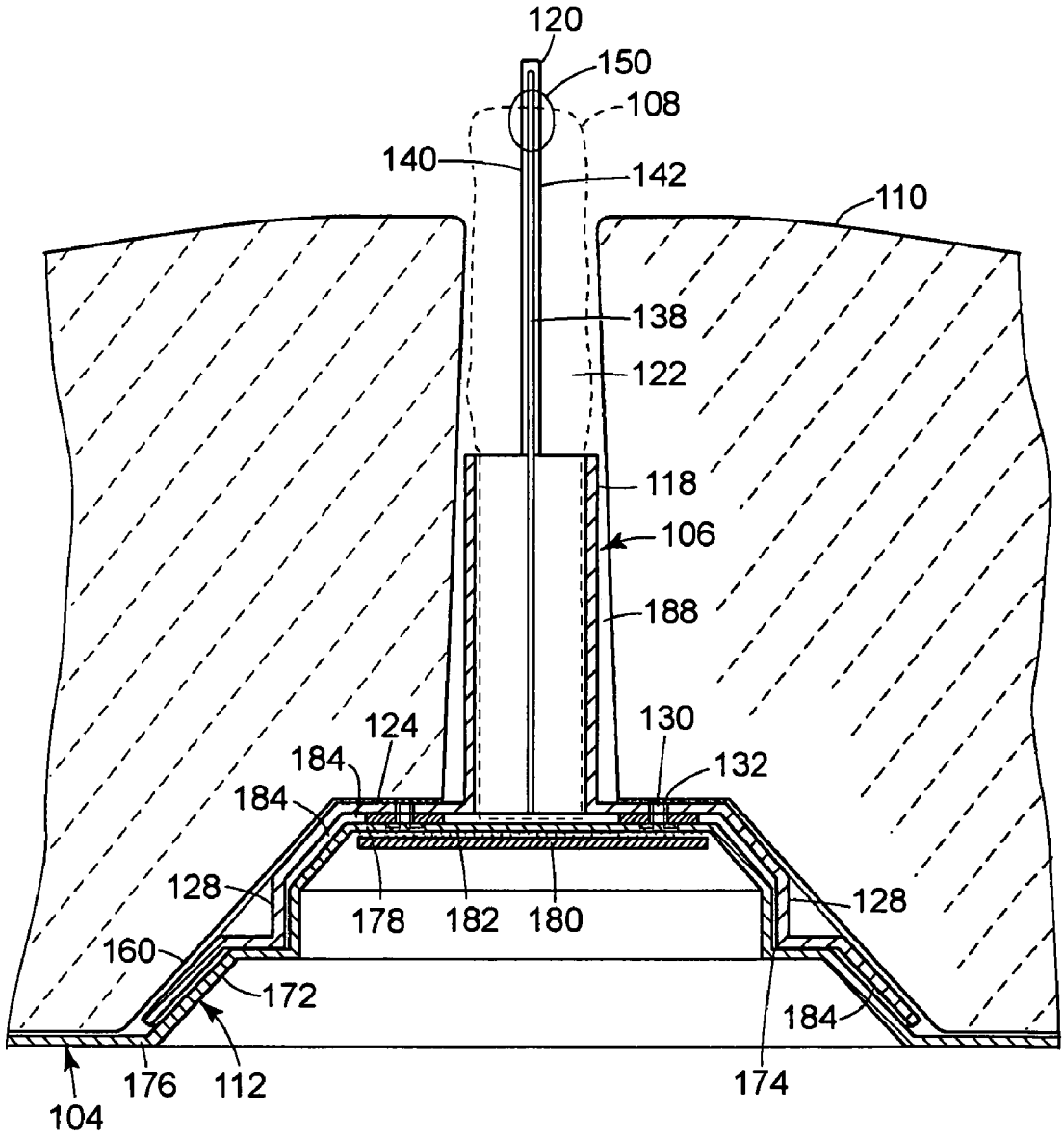
FIG. 11 is an enlarged partial cross-sectional view along the line 11-11 of FIG. 10.

As illustrated in FIG. 11, a portion of the melting plate 104, capillary pedestal 112, wick holder 106, fuel element 110, and wick 108 are shown assembled and ready for use or initial ignition by a user. In one embodiment, the capillary pedestal 112 includes an inclined sidewall 172 having an annular groove 174 extending therearound in a medial position between a floor 176 of the melting plate 104 and a top wall 178 of the capillary pedestal. A magnet 180 is secured to an underside of the top wall 166 with adhesive 182. In another embodiment, the magnet 180 may be disposed on an upper side of the top wall 178 or at another location sufficient to attract the wick holder 106. The spacers 128 are adapted to seat in the annular groove 174 to provide a capillary space 184 between the base skirt 126 and the inclined sidewall 172 sized to facilitate capillary movement of melted or liquid fuel material toward the wick 108. The spacers 128 also help retain the wick holder 106 on the capillary pedestal 112 by seating in the annular groove 174. In addition, the steel rivet 132 in the wick holder 106 is attracted to the magnet 186 when placed over the capillary pedestal 112 and thereby prevents the wick holder from accidentally falling or slipping off of the capillary pedestal. When placed on an underside of the end plate 124, the steel rivets 132 also act as spacers to help maintain the capillary space 184. In another embodiment, magnets 186 may be secured to the end plate 124 by any convenient means, such as with an adhesive or by a rivet, in order to maintain the wick clip 106 in position on the capillary pedestal 112. The cavity wall 160 of the fuel element 110 is shaped to closely fit around the base skirt 126 and barrel 118 of the wick holder 106 and rest on the floor 176 of the melting plate in order to minimize open space 188 between the fuel element and the wick 108, the wick holder 106, and the melting plate floor 176. Minimizing the open space 188 increases the likelihood of having melted fuel material feed directly to the wick 108 rather than falling downwardly to the floor 176 or accumulating in the open space and thereby potentially starving the wick of fuel material while burning. However, as melted liquid fuel material accumulates about the base of the capillary pedestal, whether due to melting from the melting plate 104 or from direct melting by a flame on the wick 108, the liquid fuel material is drawn upwardly along the capillary space 184 by capillary action toward the non-consumable wick areas 150 while the candle is burning. The wick 108 in one embodiment extends through the open end 134 of the barrel 118 to touch or nearly touch the top wall 178 of the capillary pedestal 112 so that liquid fuel material drawn up the capillary space 184 will engage the wick 108 and be drawn upwardly therein for eventual burning by a flame burning atop the wick. The wick barrel 118 has an inside diameter sufficient to receive the wick 108. The inside diameter of the barrel 118 may be larger, smaller, or the same as the diameter of the wick and may be uniform or have different diameters along a length thereof. In one embodiment, the inside diameter of the barrel 118 is larger than the diameter of the wick 108 so that the wick may be easily inserted into the barrel. In another embodiment, the inside diameter of the barrel 118 is uniformly approximately 0.012" (0.3 mm) larger than the diameter of the wick 108. In yet other embodiments, the inside diameter of the barrel 118 is the same size as or smaller than the wick 108. Melted fuel material can seep into the capillary space 184 through the weep holes 130 and thereby prime or facilitate capillary action upward through the capillary space 184. Liquid fuel material may also be drawn upwardly in the capillary space 138 between opposing sides 140, 142 of the fins 120 and drawn to the non-combustible wick areas 150 where the fuel material may be vaporized and ignited by a flame on the wick 108.

Figure 12:
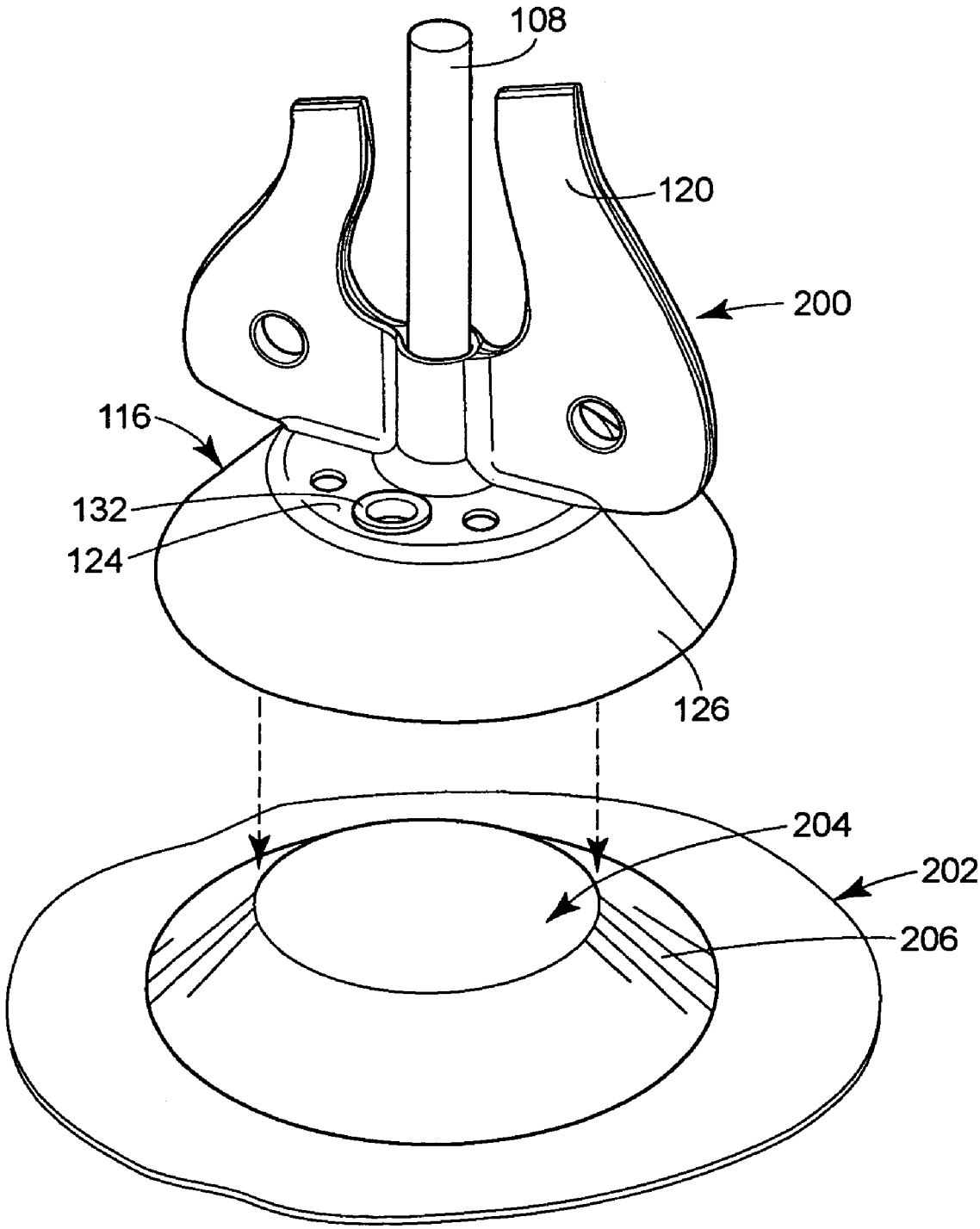
FIG. 12 is an enlarged isometric view of a wick holder and a portion of a melting plate according to yet another aspect of the invention.

Turning now to FIG. 12, another wick holder 200 and melting plate 202 are shown that are similar to the wick holder 106 and melting plate 104 shown in FIGS. 7-11, except that a capillary pedestal 204 includes a smooth inclined sidewall 206 without the annular groove 174, and the wick holder 200 does not include the spacers 128 in the base skirt 126. A capillary space (not shown), similar to 184, is maintained between the base skirt 126 and the sidewall 206 by steel rivets 132 protruding below an end wall, such as 124, of a base portion 116 of the wick holder 200. In this embodiment, the wick holder 200 is maintained on the capillary pedestal 204 substantially by the attraction between the steel rivets 132 and magnet 180 (not shown) in the capillary pedestal and any weight of the fuel element 110.

Figure 13:
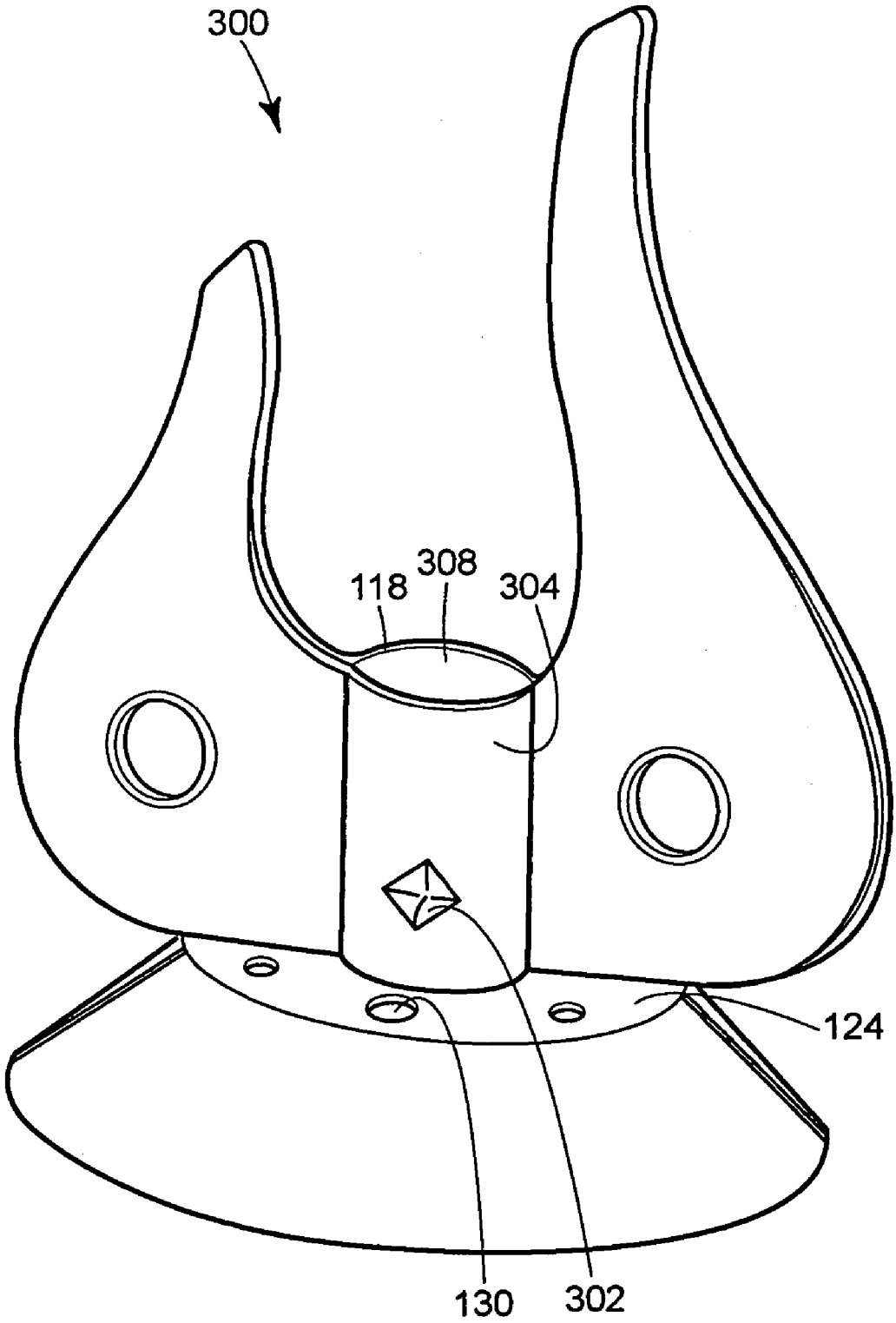
FIG. 13 is an isometric view of still another wick holder according to the present invention.
Figure 14:
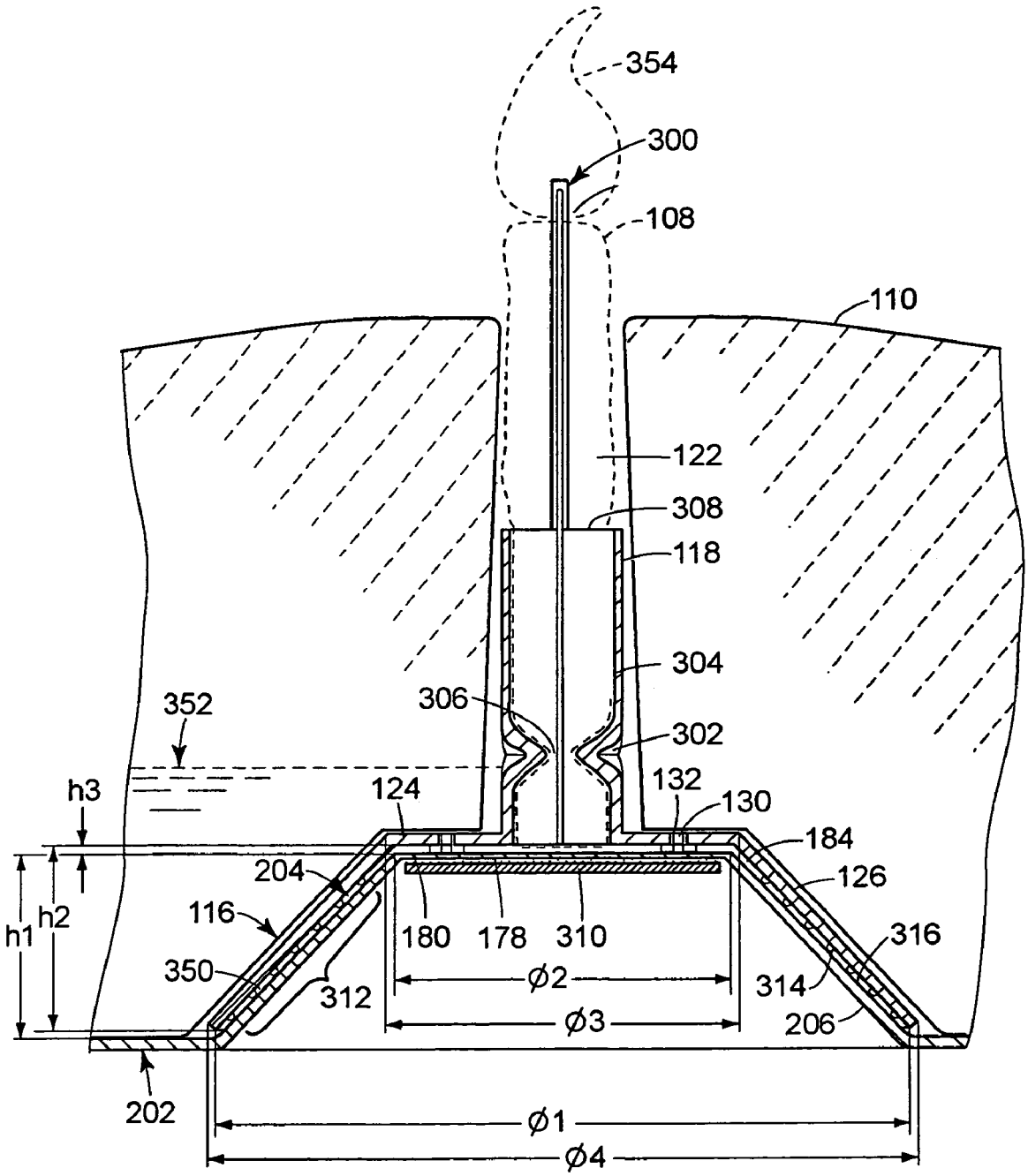
FIG. 14 is an enlarged cross-sectional view of the wick holder shown in FIG. 12 in a similar view as shown in FIG. 11.

Turning to FIGS. 13 and 14, a wick holder 300 of another embodiment for use in a candle assembly, such as 100, is similar to the wick holder 106 (or 200) except that the wick holder 300 also includes a medial portion of a barrel 118 having a cross-sectional area that is less than a cross-sectional area of any other portion of the wick barrel. An indentation 302 in a sidewall 304 of the barrel 118 defines a constricted portion 306 of the barrel located or disposed intermediate opposite ends 308 and 310 of the barrel and having a cross-sectional area less than any other portion of the barrel. A wick 108 extends through the barrel 118 such that a portion or end of the wick adapted to absorb melted or fluid fuel material extends downwardly through the end 310 and another portion or end of the wick adapted for ignition extends upwardly through end 308. The constricted portion 306 reduces an effective wick cross-sectional area, and thereby may reduce or restrict a capillary fluid flow capacity of the wick between the first open end and the second open end. The restricted flow capacity, and subsequently reduced volume flow rate, of fluid fuel material up the wick from end 310 toward a flame region above end 308, in turn may reduce the fuel material burn rate and extend the life of the fuel element 110. Because a constricted portion 306 having a larger cross-sectional area allows a faster volume flow rate, or increased capillary fluid flow capacity, than a constricted portion having a smaller cross-sectional area, the capillary fluid flow capacity of the wick may be substantially reduced by reducing the cross-sectional area of the constricted portion. Such a constriction on the flow rate of fuel material upwardly along the wick 108 past the constricted portion 306 is enhanced when the sidewall 304 is substantially liquid impervious (i.e., does not allow fuel material to pass therethrough to the wick 108) which thereby restricts the flow of fuel material into the wick to coming only through the end 310 located in the end plate 124 or above the end 308 of the barrel 118. The indentation 302 also helps maintain the wick 108 in a predetermined position within the barrel 118 such that, for example, an end portion of the wick extends through or to the end 310 in order to prevent the wick from being pulled out of the barrel and thus potentially losing contact with the flow of fuel material toward the wick through the capillary space 184 and weep holes 130.

Other variations and embodiments of the candle assembly and wick holder 300 described in detail herein are also specifically contemplated. For example, in one embodiment, the barrel 118 may take the form of a sleeve having a cylindrical shape or a tubular shape having other cross-sectional areas and shapes. In another embodiment, the constricted portion 306 in the barrel 118 is formed by an inner annular ridge (not shown), which may be formed by indenting or crimping the sidewall 304 entirely around the wick barrel 118 or by an inner annular shoulder disposed on an inner surface of the sidewall 304. The constricted portion 306 in another embodiment may be formed by a single indentation 302 or by a plurality of indentations, which may be either in opposing relationship or offset from each other. In another embodiment (not shown) the barrel 118 may have form of a wick casing that is not generally tubular, but rather includes a longitudinally curved sidewall that encases a portion of the wick 108 and has first and second openings in the sidewall through which the wick extends.

In another aspect, shown in FIG. 14 and incorporable into any of the embodiments disclosed herein, the wick holder 300 includes a skirt 126 having an underside with a textured surface 312, such as formed by small protrusions 314, indentations, striations, ridges, grooves, etchings, or adhered particles, for example, opposing a capillary pedestal 204. In one embodiment, the textured surface 312 has a substantially random texture and extends across the entire underside of the skirt 126. In another embodiment, the textured surface 312 has a repeating texture pattern and extends across only portions of the underside of the skirt 126. The textured surface 314 in one embodiment is adapted to help remove excess solidified fuel, such as cooled wax, from an outer surface 316 of a sidewall 206 of the capillary pedestal 204 when the wick holder 300 is removed from the capillary pedestal. The textured surface 314 in another embodiment helps maintain a minimum capillary space 184 between the skirt 126 and the capillary pedestal 204.

In another aspect of the present invention, which is shown in FIG. 14 but which is also applicable to any combination of any of the capillary pedestals and any of the capillary pedestals described herein, the capillary space 184 defines a volume, or capillary well 350, between a base portion 116 of the wick holder 300 and the capillary pedestal 204 that has a dimension preselected to promote a successful sustained relight of the wick 108 after a pool 352 (shown in dashed lines) of wax or other meltable fuel has been formed in melting plate 202 around the peripheral skirt 126 and capillary pedestal and then allowed to solidify. During a sustained burn, liquefied wax from the pool 352 is drawn into the capillary well 350 and up to the wick 108 by capillary action to feed a flame 354 at wick 108. If the flame 354 is extinguished prior to consuming the entire fuel element 110, the pool 352 of wax solidifies and extends across the bottom of the melting plate 202, through the capillary well 350, and into the wick 108. In one embodiment when the wick 108 is re-lit after the pool 352 of wax has solidified, the capillary space 184 is dimensioned such that a supply of liquefied wax is quickly formed and available in the capillary well 350 to feed the flame via the wick 108 until the wax surrounding the peripheral skirt 126 has melted sufficiently to provide a supply of liquefied fuel to replace the wax in the capillary well. For example, if the capillary space 184 is dimensioned too small, there may not be enough wax in the capillary well 350 to sustain the flame on the wick during a sustained relight before the wax pool 352 surrounding the peripheral skirt 126 has melted enough to provide additional liquefied fuel to the wick 108. Also for example, if the capillary space 184 is too large, heat transfer through the solidified wax in the capillary well 350 may be too slow to melt enough of the wax therein to provide liquefied fuel to the wick 108 before wax in the wick is burned. Under either circumstance, the flame 354 may run out of fuel and extinguish prior melting a sufficient amount of wax in the pool 352 to begin or sustain substantially continuous capillary movement of the melted wax from outside of the capillary space 184, into the capillary well 350, and up the wick 108 to feed the flame 354. Therefore, to assist in a successful sustained relight of the wick 108 in one embodiment, the capillary well 350 has a volume not less than a volume sufficient to provide melted fuel to the relit wick 108 until a sufficient amount of liquefied fuel is formed from the pool 352 of solidified wax adjacent to or surrounding the peripheral skirt 126 to continuously feed the flame 354 by capillary action through the capillary space 184, and in another embodiment, the volume of the capillary well 350 is not more than a volume able to allow heat from the flame 354 to melt the solidified fuel disposed in the capillary space 184 sufficiently rapidly to feed the flame 354 after solidified fuel carried in the wick is burned. In a further embodiment, a successful relight can be achieved if the volume of the capillary well 350 is proportional to a thermal mass of an entire candle assembly, such as 100, in order to provide a sufficient source of rapidly melted fuel to the wick until the pool 352 of solidified wax has melted sufficiently to provide an adequate flow of fuel to the wick 108 to maintain a sustained burn of the flame 354. The thermal mass of the candle assembly 100 is a measure of the amount of energy needed to change the temperature of the entire melting plate candle by a measured amount and is equal to the sum of the products of the mass of each portion of the candle assembly multiplied by the specific heat of that portion. According to one aspect, the proportion of the volume of the capillary well 350 to the thermal mass of the candle assembly is between about 0.00006 cubic inches per calorie per degree centigrade (hereinafter, $in^3$/cal/° C.) (1 $mm^3$/cal/° C.) and about 0.0006in $^3$/cal/° C. (10 $mm^3$/cal/° C.) is more preferably between about 0.0001 $in^3$/cal/° C. (2 $mm^3$cal/° C.) and about 0.0004 $in^3$/cal/° C. 6 mm $^3$/cal/° C.), and is even more preferably between about 0.00018 $in^3$/cal/° C. (3 $mm^3$/cal/° C.) and about 0.00024 $in^3$/cal/° C. (4 $mm^3$/cal/° C.). Accordingly, in one embodiment the thermal mass of the candle assembly is between about 135 cal/° C. and 10 cal/° C., and more preferably between about 75 cal/° C. and 40 cal/° C., and even more preferably, between about 61 cal/° C. and about 50 cal/° C., and the volume of the capillary well 350 is preferably between about 0.006 $in^3$ (100 $mm^3$) and about 0.03 $in^3$ (500 $mm^3$), more preferably between about 0.009 $in^3$ (150 $mm^3$) and 0.018 $in^3$ (300 $mm^3$), and even more preferably about 0.012 $in^3$ (200 $mm^3$).

For example, the thermal mass of an embodiment of a candle assembly, such as 100, includes a support base 102, melting plate 202, and wick holder 300 having a combined thermal mass of about 50 cal/° C. and a fuel element 110 of approximately 0.53 oz. (15 g) of wax having a thermal mass of about 10.5 cal/° C. before being burned. The capillary pedestal 204 has a generally frustoconical shape with a height h1 between about 0.39" (10 mm) and 0.04" (1 mm), and more preferably about 0.2" (5 mm), a bottom radius Φ1 between about 1.18" (30 mm) and 0.39" (10 mm), and more preferably about 0.83" (21 mm), and a top radius Φ2 between about 0.04" (1 mm) and 0.79" (20 mm), and more preferably about 0.43" (11 mm). The base 116 has a frustoconical shape generally complementary to the capillary pedestal with the peripheral skirt 126 having an upper diameter Φ3 of between about 0.08" (2 mm) and about 0.83" (21 mm), and more preferably between about 0.43" (11 mm) and about 0.55" (14 mm), and even more preferably about 0.51" (13 mm); a bottom diameter Φ4 between about 1.22" (31 mm) and about 0.43" (11 mm), more preferably between about 0.79" (20 mm) and about 0.91" (23 mm), and even more preferably about 0.87" (22 mm); a height h2 between about 0.43" (11 mm) and 0.08" (2 mm), more preferably between about 0.28" (7 mm) and about 0.16" (4 mm), and even more preferably about 0.2" (5 mm); and a height h3 of the rivets 132 from the end plate 124 of between about 0.004" (0.1 mm) and 0.04" (1 mm), more preferably between about 0.03" (0.8 mm) and about 0.02" (0.5 mm), and even more preferably about 0.02" (0.6 mm). In another embodiment, the capillary pedestal 204 has a height h1 about 0.18" (4.7 mm), a bottom radius Φ1 about 0.81" (20.5 mm), a top radius Φ2 about 0.44" (11.1 mm), and the base 126 has a skirt 126 having an upper diameter Φ3 about 0.5" (12.6 mm), a bottom diameter Φ4 about 0.85" (21.6 mm), and a height h2 about 0.2" (5.05 mm). When the base 116 is placed on top of the capillary pedestal 204, the end plate 124 is a perpendicular distance of about 0.03" (0.65 mm) from a top wall 178 of the capillary pedestal, and the peripheral skirt 126 is perpendicular distance of about 0.02" (0.38 mm) from the sidewall 206, which defines a capillary well 350 having a volume of approximately 0.012 $in^3$ (200 $mm^3$).

Figure 15:
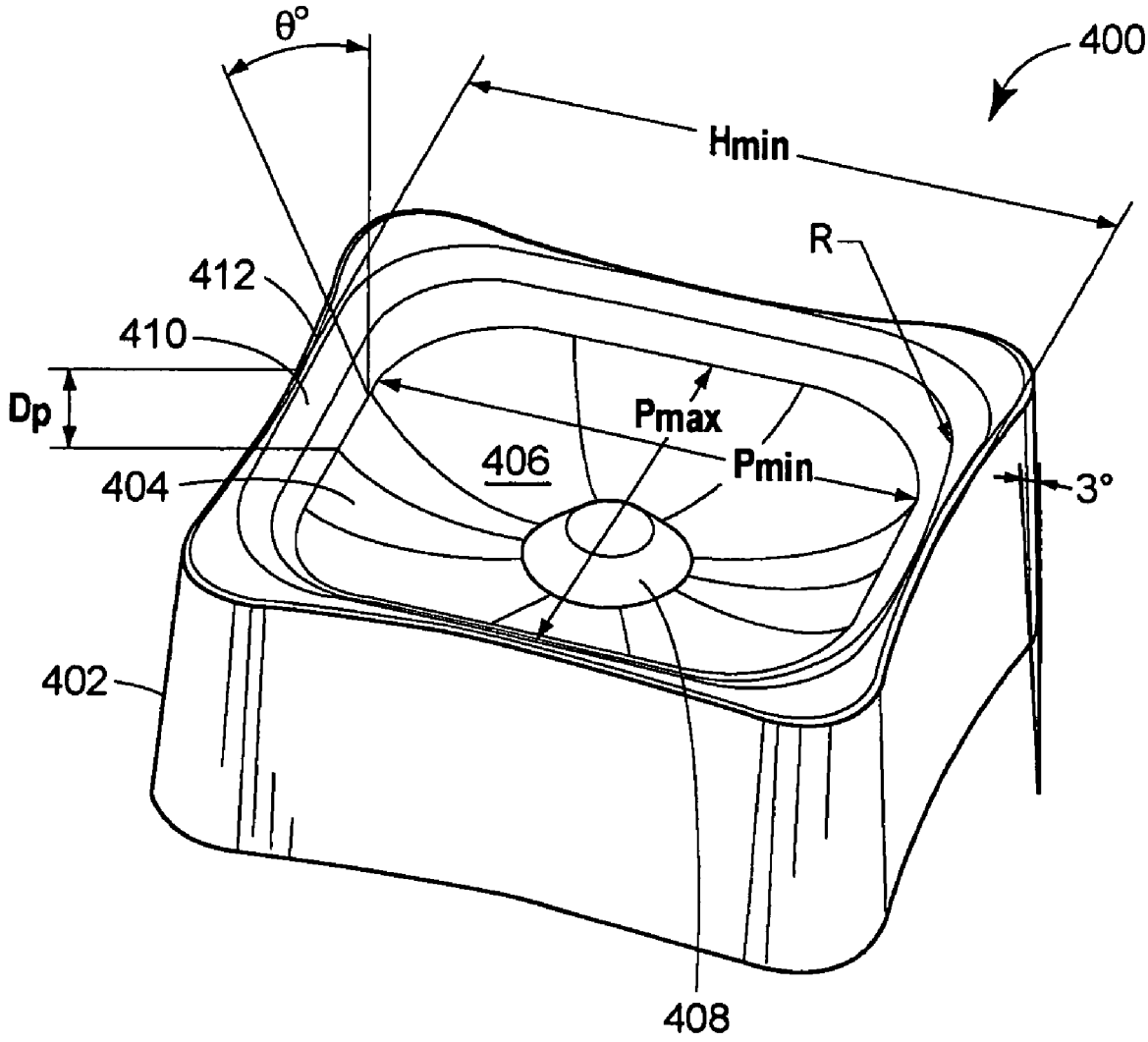
FIG. 15 is an isometric view of a candle holder according to another aspect of the present invention.

Turning now to FIG. 15, a candle holder 400 for a melting plate candle assembly according to another aspect of the invention is shown including a holder or base 402 and a generally concave melting plate 404 carried within a recessed portion 406 of the base. (A solid fuel element and wick holder similar to those already described herein that rest on the melting plate are not shown for purposes of clarity) The melting plate 404 has high thermal conductivity and is similar to other melting plates described previously herein, including a capillary pedestal 408 protruding upwardly therefrom at a centrally disposed wick location. The base 402 includes a wall 410 extending around and angularly disposed outwardly at a zenith angle θ from the melting plate 404 and having an uppermost or top edge 412 disposed above the melting plate. In one aspect, the base 402 and the melting plate 404 have a geometry that is adapted to increase or promote substantially laminar air flow (when surrounded by a calm atmospheric environment) over a pool of molten or liquefied fuel when a flame is disposed in close proximity above the pool during a burn, such as, for example, when a flame is present on a wick such as the wick 108. Such laminar air flow controls the overall temperature of the pool by reducing eddy currents over the pool and reducing or minimizing localized hot spots in the pool, which slows volatilization of active volatile ingredients in the fuel, such as a fragrance or insecticide, and thereby extends an effective fragrancing period of the fuel until the fuel is completely burned. Ideally, when all the fuel is liquefied in the pool during the burn of the melting plate candle, air is drawn in substantially laminar flow over the top edge 412 of the wall 410 into the recessed portion 406, over the melting plate 404 and a pool of liquefied fuel, such as melted wax, by a heat chimney, or upward air currents, caused by a flame on a wick disposed over the capillary pedestal 408. The air currents ascending up the heat chimney also distribute the volatilized active ingredient into the surrounding environment.

In one embodiment, the base 402 and the melting plate 404 have a geometry to increase or promote substantially laminar air flow described by the following relationships:

$$20{,}000\ \text{mm}^2+(P\text{min}^2-P\text{max}^2)\geqq SA\geqq 2{,}500\ \text{mm}^2+(P\text{max}^2-P\text{min}^2); \quad 1$$

$$Dp\text{max}\leqq(SA/1{,}000\ \text{mm})+\{[(H\text{min}-P\text{min})/2]\sin\theta\}; \quad 2$$

$$P\text{min}\geqq 6(Dp)(\cos\theta);\ \text{and/or} \quad 3$$

$$H\text{min}\approx P\text{min}+2[R+(Dp-R)\tan\theta]; \quad 4$$

in which:

Pmax is a maximum width across the melting plate 404 in mm;

Pmin is a minimum width across the melting plate 404 in mm;

SA is a projected surface area, or surface area of a two-dimensional projection of an outline, of the melting plate 404 in square millimeters;

Hmin is a minimum width of the base 402 at the top edge 412 in mm;

Dp is a depth of the melting plate 404 from the top edge 412 of the base 402 in mm;

Dpmax is a maximum value for Dp in mm;

R is an outside radius of the upper edge of the base 402 in mm; and

θ is the zenith angle of the wall 410 in degrees.

Equation 1 quantifies an approximate relationship of the projected surface area of the melting plate and the width across the melting plate, within upper and lower constant boundaries, to promote the laminar air flow. Equation 2 quantifies an approximate relationship of the projected surface area of the melting plate 404 and the depth of the melting plate 404 from the top edge 412 of the base 402 to promote the laminar air flow. Equation 3 quantifies an approximate relationship of the minimum width across the melting plate and the depth of the melting plate 404 from the top edge 412 of the base 402 and the zenith angle of the base wall 410 to promote the laminar air flow. Equation 4 quantifies an approximate minimum width of the base 402 at the top edge 412 as a function of the geometries of the melting plate 404 and the base to promote the laminar airflow. Although the relationships 1-4 above have been described in relation to a generally rectangular base and holder, the relationships may also be used with other candle holder shapes, such as oval and circular, in order to approach an optimized candle holder geometry. For example, in one embodiment comprising a circular base and melting plate, such as the base 102 and melting plate 104 shown in FIG. 7, Hmin is approximately 3.94"(100 mm), Pmax and Pmin are both equal to approximately 3.15"(80 mm), Dp is approximately 0.4"(10 mm), R is approximately 0.08"(2 mm), and θis approximately 45°.

The invention having been described in an illustrative manner, it is to be understood that the terminology used is intended to be in the nature of description rather than of limitation. The various components of the various melting plate candle assemblies described herein may be packaged as an assembled unit, as an unassembled kit including all or a portion of the components, as individual components, and in any combination thereof. Other variations, modifications, and equivalents of the present invention possible in light of the above teachings are specifically included within the scope of the impending claims.

We claim:

1. A wick assembly comprising:

an enclosed wick casing extending between a first open end and a second open end;

a wick extending between the first open end and the second open end with at least a portion of the wick surrounded by the wick casing;

a base portion at the first open end, the base portion comprising a peripheral skirt that projects outwardly and downwardly from the wick casing and a textured inner surface that is shaped and sized to conform closely around an upwardly projecting pedestal; and a restricted portion of the wick casing having a cross sectional area less than a cross sectional area of either the first open end or the second open end, wherein the restricted portion of the wick casing reduces an effective capillary flow capacity along the wick.

2. The wick assembly of claim 1, wherein the cross-sectional area of the first open end is substantially the same as the cross-sectional area of the second open end.

3. The wick assembly of claim 2, wherein the wick casing is a tube.

4. The wick assembly of claim 3, wherein the wick casing is a cylinder.

5. The wick assembly of claim 1, wherein the restricted portion of the wick casing is defined by a minimum of one indentation in the wick casing.

6. The wick assembly of claim 1, wherein the restricted portion of the wick casing is defined by a plurality of indentations in the wick casing.

7. The wick assembly of claim 5, wherein the indentation is an annular ridge.

8. The wick assembly of claim 1, wherein the wick protrudes from the first open end and the second open end, and wherein the wick is adapted to absorb fluid fuel material at a base end thereof and to be lighted at an end opposite the base end.

9. The wick assembly of claim 8, wherein the base portion is adapted to provide a supply of melted fluid fuel material to the base end of the wick.

10. The wick assembly of claim 9, wherein the base portion is adapted to cause capillary flow of melted fuel material toward only the base end of the wick when engaged over a capillary pedestal.

11. The wick assembly of claim 9, wherein openings through the base portion are adapted to provide the supply of melted fluid fuel material to the base end of the wick.

12. The wick assembly of claim 1, wherein the restricted portion of the wick casing includes an indentation in the wick casing that fixedly maintains the wick in a preselected position.

13. A wick holder comprising:

an elongate enclosed wick casing extending from a base portion and having a first open end and a second open end, wherein the base portion includes an end wall and a down-turned annular skirt extending from the end wall in an opposite direction from the wick casing, and wherein the annular skirt has a textured inner surface that is shared and located to maintain a capillary space between the annular skirt and an upward projection surrounded by the annular skirt; and a constricted portion of the wick casing, wherein the constricted portion restricts an effective capillary fluid flow capacity between opposite open ends of the wick casing.

14. The wick holder of claim 13, wherein the first open end is in the end wall and the second open end is opposite the first open end.

15. The wick holder of claim 13, wherein the constricted portion includes an indentation in the wick casing.

16. The wick holder of claim 13 further including a fin for transferring thermal energy away from the casing.

17. A wick assembly comprising:

a tube having a sidewall extending between a first open end and a second open end;

a base at one end of the tube for supporting the tube in a substantially vertical position, wherein the base portion comprises a peripheral skirt that projects outwardly and downwardly from the tube and a textured inner surface that is shaped and sized to conform closely around an upwardly projecting pedestal; and, a wick at least partly disposed in the tube and extending between the first open end and the second open end.

* * * * *

UNITED STATES PATENT AND TRADEMARK OFFICE

CERTIFICATE OF CORRECTION

PATENT NO. : 7,318,724 B2
APPLICATION NO. : 11/124313
DATED : January 15, 2008
INVENTOR(S) : Chris A. Kubicek et al.

It is certified that error appears in the above-identified patent and that said Letters Patent is hereby corrected as shown below:

Column 16, Line 1: replace “shared” with --shaped--

Signed and Sealed this

Fourth Day of November, 2008

JON W. DUDAS
*Director of the United States Patent and Trademark Office*